US005704304A

United States Patent [19]

Burton et al.

[11] Patent Number: 5,704,304

[45] Date of Patent: Jan. 6, 1998

[54] LEVEL LINING APPARATUS AND METHOD

[75] Inventors: Perry E. Burton, Marietta; John V. Noonan, Greenville, both of S.C.

[73] Assignee: Burton & Noonan, Easley, S.C.

[21] Appl. No.: 372,190

[22] Filed: Jan. 13, 1995

Related U.S. Application Data

[63] Continuation-in-part of Ser. No. 250,797, May 27, 1994, Pat. No. 5,572,940.

[51] Int. Cl.[6] ..... D05B 27/12

[52] U.S. Cl. ..... 112/470.31; 112/475.07; 226/44; 226/108

[58] Field of Search ..... 112/307, 305, 112/314, 318, 306, 470.01, 470.03, 470.07, 475.07, 470.31, 470.32; 226/44, 111, 174, 178, 108, 109; 242/420.6, 594

[56] References Cited

U.S. PATENT DOCUMENTS

| | | | |
|---|---|---|---|
| 800,086 | 9/1905 | Dixon . | |
| 1,110,704 | 9/1914 | Minnick . | |
| 2,004,080 | 6/1935 | Roby . | |
| 2,544,467 | 3/1951 | Michel . | |
| 2,618,230 | 11/1952 | Pons . | |
| 2,722,415 | 11/1955 | Wood, Jr. . | |
| 2,747,866 | 5/1956 | Schmidt . | |
| 2,760,734 | 8/1956 | Hornberger . | |
| 2,825,016 | 2/1958 | Bailey . | |
| 2,842,361 | 7/1958 | Miller . | |
| 2,844,773 | 7/1958 | Turner et al. . | |
| 2,907,291 | 10/1959 | Schrader . | |
| 2,940,407 | 6/1960 | Mitchell . | |
| 3,013,513 | 12/1961 | Judelson . | |
| 3,054,547 | 9/1962 | Alexeff et al. . | |
| 3,164,332 | 1/1965 | Walker et al. . | |
| 3,204,590 | 9/1965 | Rockerath et al. . | |
| 3,365,143 | 1/1968 | Espel . | |
| 3,417,718 | 12/1968 | Andersson . | |
| 3,463,482 | 8/1969 | Baron et al. . | |
| 3,525,367 | 8/1970 | Sprague . | |
| 3,534,954 | 10/1970 | Lynch, Jr. . | |
| 3,581,963 | 6/1971 | Rule . | |
| 3,582,064 | 6/1971 | Weidman . | |
| 3,600,220 | 8/1971 | Marforio . | |
| 3,608,891 | 9/1971 | Hannon et al. . | |
| 3,610,493 | 10/1971 | Brocklehurst . | |
| 3,640,235 | 2/1972 | Burton . | |
| 3,772,948 | 11/1973 | Burton . | |
| 3,773,002 | 11/1973 | Burton . | |
| 3,807,613 | 4/1974 | Holm | 226/44 X |
| 3,847,099 | 11/1974 | Braun | 112/470.31 |
| 3,877,559 | 4/1975 | Burgin . | |
| 3,889,614 | 6/1975 | Nicolay et al. . | |
| 3,906,878 | 9/1975 | Burton . | |
| 3,912,145 | 10/1975 | Meihofer | 226/44 |
| 4,034,690 | 7/1977 | Breck, Jr. . | |
| 4,038,931 | 8/1977 | Kosrow et al. . | |
| 4,063,327 | 12/1977 | Barber . | |
| 4,095,538 | 6/1978 | Rockerath et al. . | |
| 4,132,184 | 1/1979 | Burton . | |

(List continued on next page.)

FOREIGN PATENT DOCUMENTS

| | | |
|---|---|---|
| 3047972 | 11/1983 | Germany . |

*Primary Examiner*—Peter Nerbun
*Attorney, Agent, or Firm*—Dority & Manning, P.A.

[57] ABSTRACT

An apparatus and method are provided for simultaneously feeding two or more rolls of material into a sewing and cutting system. Specifically, the apparatus includes a roll let-off for supporting and feeding a first roll of material or cloth. The let-off includes a tension control unit for feeding the cloth at constant tension. A second roll let-off is also included for supporting and feeding a second roll of material. The second roll let-off also includes a tension control unit in combination with a torque supplying device. The tension control unit and the torque supplying device are adjusted to place a single tension on the material that allows the second roll of material to be fed with the first roll of material simultaneously and uniformly. By using the apparatus of the present invention, improved sewn products can be produced automatically.

23 Claims, 28 Drawing Sheets

OTHER PUBLICATIONS 4,154,180 5/1979 Burton .
4,157,692 6/1979 Brocklehurst .
4,186,672 2/1980 Burton .
4,204,012 5/1980 Brocklehurst et al. .
4,224,886 9/1980 Burton .
4,227,684 10/1980 Brocklehurst .
4,269,130 5/1981 Burton et al. .
4,271,767 6/1981 Burton et al. .
4,271,774 6/1981 Burton .
4,353,316 10/1982 Brocklehurst .
4,437,369 3/1984 Brocklehurst et al. .
4,438,714 3/1984 Smith et al. .
4,462,322 7/1984 Brocklehurst .
4,491,079 1/1985 Gustavsson .
4,505,467 3/1985 Brocklehurst .
4,595,133 6/1986 Brocklehurst .
4,624,198 11/1986 Beam et al. .
4,688,499 8/1987 Moore et al. .
4,825,787 5/1989 Babson et al. .
4,836,119 6/1989 Siraco et al. .
4,896,617 1/1990 Hauser et al. .
4,932,344 6/1990 Tatum .
4,966,090 10/1990 Tanaka et al. .
5,001,998 3/1991 Suzuki et al. .
5,044,289 9/1991 Keeton .
5,062,374 11/1991 Wokeck et al. .
5,186,115 2/1993 Rouleau et al. .
5,197,400 3/1993 Prais .
5,203,268 4/1993 Schips .
5,226,378 7/1993 Suzuki et al. .
5,441,004 8/1995 Bottoms et al. .
5,456,193 10/1995 Boot ..... 112/307 X

LEVEL LINING APPARATUS AND METHOD

This application is a Continuation-in-part of application U.S. Ser. No. 08/250,797 filed May 27, 1994 now U.S. Pat. No. 5,572,940.

BACKGROUND OF THE INVENTION

This invention relates to a method and apparatus for producing finished sewn products from a roll of cloth. The method and apparatus pertains to cutting predetermined lengths of fabric from a large roll of fabric and then performing various sewing operations on the fabric to produce articles such as lined drapes, sheets, valances, etc. More particularly, the present invention is directed to a method and apparatus that automatically feeds two or more rolls of material together while maintaining the layers of material in alignment.

Heretofore, one of the major expenses in producing sewn products was cutting lengths of fabric to precise lengths and then sewing folded hems on the edge of the fabric prior to performing additional sewing operations. Another major concern has been the ability to feed a face fabric and a liner into a sewing operation at constant tensions so that the two fabrics stay in alignment with respect to each other. Such has been time consuming and labor intensive adding considerable cost to the finished products.

OBJECTS AND SUMMARY OF THE INVENTION

It is a principal object of the present invention to provide a method and apparatus for efficiently cutting fabric into predetermined lengths and automatically performing sewing operations thereon.

Another important object of the present invention is to provide a method and apparatus for automatically cutting fabric from a large roll and then automatically folding the edges of the fabric. The folded edges are then sewn into hems, and the fabric is transported to a folding station. After the fabric has been folded at the folding station, it is then transported to another sewing station for performing sewing operations thereon.

Still another important object of the present invention is to provide an efficient and automatic system for folding and sewing sheet material.

Still another important object of the present invention is to provide an efficient method and apparatus for automatically producing sewn valances from a roll of cloth.

Still another important object of the present invention is to provide an apparatus and method for automatically producing hemmed fabric for subsequent manufacture into drapes and the like.

Still another important object of the present invention is to provide a method and apparatus for cutting fabric in predetermined lengths, folding the edges of the fabric to produce precise hems and then transporting said fabric to a receiver.

A further object of the present invention is to provide a method and apparatus for precisely folding fabric of a predetermined length into a desired folded pattern for subsequent sewing.

Still another important object of the invention is to provide a method and apparatus for automatically sewing sockets and pockets into a folded fabric to produce valances.

Another object of the present invention is to provide a method and apparatus for automatically feeding two or more rolls of material together into a fabric processing system while maintaining the layers of material in alignment.

It is another object of the present invention to provide a method and an improved hemmed product in which the liner fabric is narrower than the face fabric for making the subsequently formed hems less thick and for improving the final appearance of the sewn product.

Additional objects of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus of the present invention comprises a let off device which carries a large roll of fabric that is to be used for producing the finished product. The fabric is unwound by the let off device which is under the control of a dancer so as to maintain uniform tension in the fabric as it leaves the let off device. The open fabric then passes under a pair of spaced edge cutters which trim opposed edges of the fabric to a predetermined width.

After the fabric has been trimmed, the edges of the fabric are folded in by a hem forming and hem width control device. The folded edge of the fabric is maintained at a precise location by means of a photoelectric sensor and a hem shifting device. The photoelectric sensor includes a pair of laterally spaced photosensors which generate signals indicating when the edge of the fabric is at the precise location in between the two photodetectors. The photodetectors in turn control the hem shifting device to keep the edge of the hem properly aligned. After the hem has been folded onto the edges of the open cloth, the hem then passes through a curling device which curls the outer edge of the hem under so as to produce a double layer hem. This curl portion is then passed under a sewing head which advances the cloth and sews the hem into the edges of the fabric. The fabric is then fed into an accumulator which accumulates a predetermined length of fabric.

Following the accumulator is a length cutter which makes a transverse cut across the fabric to cut the fabric into predetermined lengths.

In order to cut the fabric into predetermined lengths, a cloth puller moves from the downstream end of the machine to adjacent the cutting head for gripping the edge of the fabric in order to pull the fabric from the accumulator when the cloth puller is moved back towards the downstream end of the machine. After the cloth puller pulls the cloth back towards the end of the machine, a predetermined length of cloth rests on a folding table and is ready for being folded into a desired pattern. In one particular embodiment, the apparatus is used for making valances. At the folding table it is desired to fold the open fabric so that it can be subsequently sewed with elongated stitching to produce the final product.

In order to fold the open length of fabric on the folding table, a pair of spaced dies are lowered down on top of the fabric. The dies are spaced a distance that corresponds to the ultimate width of the valance.

Once the dies are lowered onto the fabric carried on the folding table, the cloth puller which is still gripping the leading edge of the fabric is moved back towards the front end of the machine, folding the fabric over a first die. It then releases the leading edge of the cloth and moves back adjacent the end of the machine. The trailing edge of the cut cloth is then folded up over the second die and overlaps the edge of the cloth that was previously folded.

The cloth in this folded position is then transported to a sewing station wherein two sewing heads are provided for sewing a pair of elongated spaced stitching so as to form a socket in the folded fabric for receiving a curtain rod as well as a pocket in the fabric. This completes the construction of the valance.

The apparatus and machine can also be used for producing lined draperies or other lined products. When being used to produce lined draperies, a second roll of fabric is carried on a second let off above the first let off which carries the facing layer of fabric. The fabrics are superimposed on each other under uniform tension. The superimposed liner and facing are then passed through the cutting and hem forming device as described above. The cloth puller is used for pulling the sewn liner and facing from an accumulator so that they can be cut to a desired length.

The folding operation discussed above takes place in a similar but wider spaced configuration when producing lined draperies.

The accompanying drawings, which are incorporated in and constitute a part of this specification, illustrate the embodiments of the invention and together with the description, serve to explain the principle of the invention.

It is to be understood that the invention is made up of a plurality of various elements. It is understood of course that equivalent components could be substituted for the elements shown in the drawings and described hereto in the specification without departing from the spirit or scope of the present invention.

Figure 1:
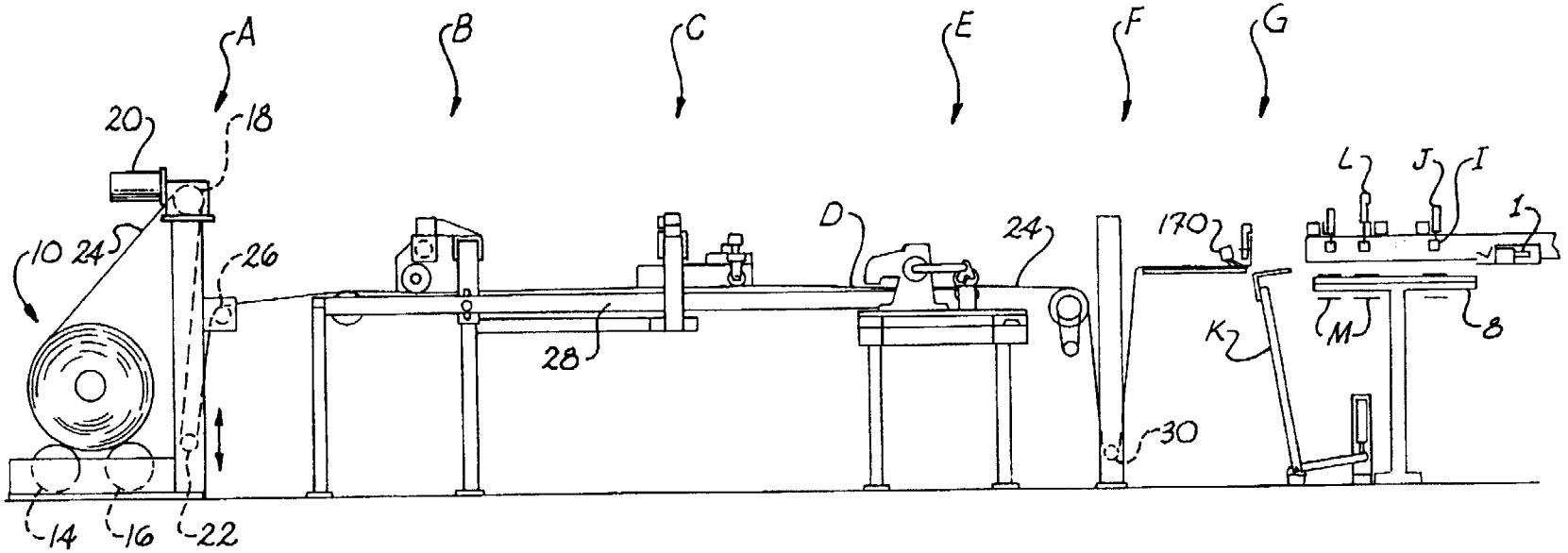
FIG. 1 is a side elevational view illustrating a portion of a machine constructed in accordance with the present invention.

Repeat use of reference characters in the present specification and drawings is intended to represent same or analogous features or elements of the invention.

DESCRIPTION OF THE PREFERRED EMBODIMENTS

Referring in more detail to the drawings, FIG. 1 is a side elevational view of the machine which is provided for hemming and cutting predetermined lengths of material from a large roll of material 10. The large roll of material 10 is carried on a let off A. The let off A includes a pair of idle rollers 14 and 16 which permit the roll 10 of cloth to be rotated when it is pulled by a power driven roll 18 which has a friction covering thereon. The power driven roll 18 is driven by an electric motor 20. The motor is a variable speed driven motor which is under control of a dancer roll 22. The dancer roll 22 is permitted to move up and down responsive to variations in tension in the cloth extending therearound. As the dancer roll 22 moves up and down, it varies the adjustment on a potentiometer that in turn varies the voltage applied to the motor drive board for varying the let off speed for the cloth. The cloth 24 is then fed from the let off A up over a guide roll 26 onto a sewing table 28. As the cloth enters the sewing table, it first passes through an edge cutting device B. There are two edge cutters B spaced on opposite sides of the table so as to cut the cloth to a predetermined width. The cloth then moves under an edge folding and positioning station C which forms a fold of a predetermined width in the edge of the cloth. This occurs on one or both sides of the cloth.

From the edge folding and positioning station C, the cloth is then fed to a hem folding mechanism D which folds the hem into a double fold. From the hem folder D, the cloth is then fed under to a hem sewing head and cloth advancer E for sewing the hem into the edge of the cloth.

The cloth is fed from the hem sewing head and cloth advancer E into an accumulator F which accumulates a cloth reserve. The cloth passes around an adjustable tension roll 30 provided in the accumulator and from the roll 30 proceeds up onto a cutting table.

Provided on the cutting table is a length cutter G which cuts the cloth from one side to the other.

The particular length of cloth that is cut at this point is controlled by a cloth puller H. To explain the operation to this point we will take up from the point where the cloth was previously cut. As a result, there is a leading edge of cloth 24 directly under where the transverse cutter blade severed the cloth.

The cloth puller H is brought up from the end of the machine into engagement with the leading edge of the cloth 24 directly under the path of the cutting blade. The cloth puller H then grips the edge of the cloth and pulls it back towards the end of the machine over a folding table 8. The cloth puller H pulls the cloth a predetermined length. Once the cloth 24 reaches that predetermined length, the cloth puller H is stopped by a proximity switch. The length cutter G then cuts the cloth extending over the table to a predetermined length.

While the cloth is on the folding table, folding dies I are lowered down on top of the cloth. Die lifters J are used for lowering the dies I down onto the cloth and retracting. Later they cycle to raise them up off of the cloth. Once the dies I are put in position on top of the cloth, the cloth puller H is moved back towards the cut edge to fold the leading edge of the cloth over the first folding die. It releases the cloth and retracts back to the end of the machine.

A trailing end folder K is then used for folding the trailing end of the cloth over the other die and other edge of the cloth. Once the cloth is folded, and in this particular instance for making a valance, a cloth hold down bar L is lowered on top of the free edges of the cloth pressing them in contact with a cloth shifter M. The cloth shifter M includes a plurality of drive belts which are supported on the folding table 8 directly beneath the bottom surface of the folded cloth and are in engagement therewith. In particular, the two dies and the cloth hold down bar L press the cloth down into engagement with the cloth shifting belts M.

The folded pattern is then shifted laterally off of the folding table.

As the folded pattern is shifted laterally off of the folding table, the leading edge comes in contact with an edge separating device N (see FIG. 26) which separates the upper edge from the lower edge and feeds it into a hem edge curler O which curls the upper edge inward to form a hem. The curled upper edge then is shifted by the cloth shifter M into engagement with the sewing head of a first sewing machine P. The first sewing machine sews the hem into the folded pattern to produce a pocket in the folded fabric. A second sewing head Q follows the first sewing head P and puts a continuous stitch in the fabric which is laterally spaced from the stitch placed by the first sewing head P so as to sew an elongated socket in the valance which is capable of receiving a curtain rod.

A photocell R is carried by the first sewing head P to sense the leading edge of the folded pattern as it is shifted by the cloth shifter M. At this point in the operation, both of the sewing heads P and Q are operating at the same speed so as to place the same number of stitches per inch in the fabric. However, upon the photosensor R sensing the leading edge of the folded pattern, it causes a signal to be generated that in turn slows down the rate that the cloth shifter is moving the cloth over the table and also slows down the stitching speed of the second sewing machine Q. As a result, the first sewing machine P goes into a tack mode to place more stitches per inch at the leading edge of the folded fabric. The tack mode continues for approximately one inch and then a controller associated with the operation of the sewing station returns the cloth edge shifter M to its original traveling speed and returns the speed of the second sewing head Q to its original speed. At this point in time, the folded fabric continues to be moved under both of the sewing heads P and Q to place a less dense stitch in the main body of the valance. Upon reaching the trailing edge of the folded pattern, the tack mode is again entered into to place more stitches per inch adjacent the trailing edge of the valance. All of this is under control of a controller that is activated by the photocell R. Any suitable controller can be used for synchronizing the operation of the feed of the fabric with the speed of the cloth shifter M and the sewing machine Q.

Figure 27:
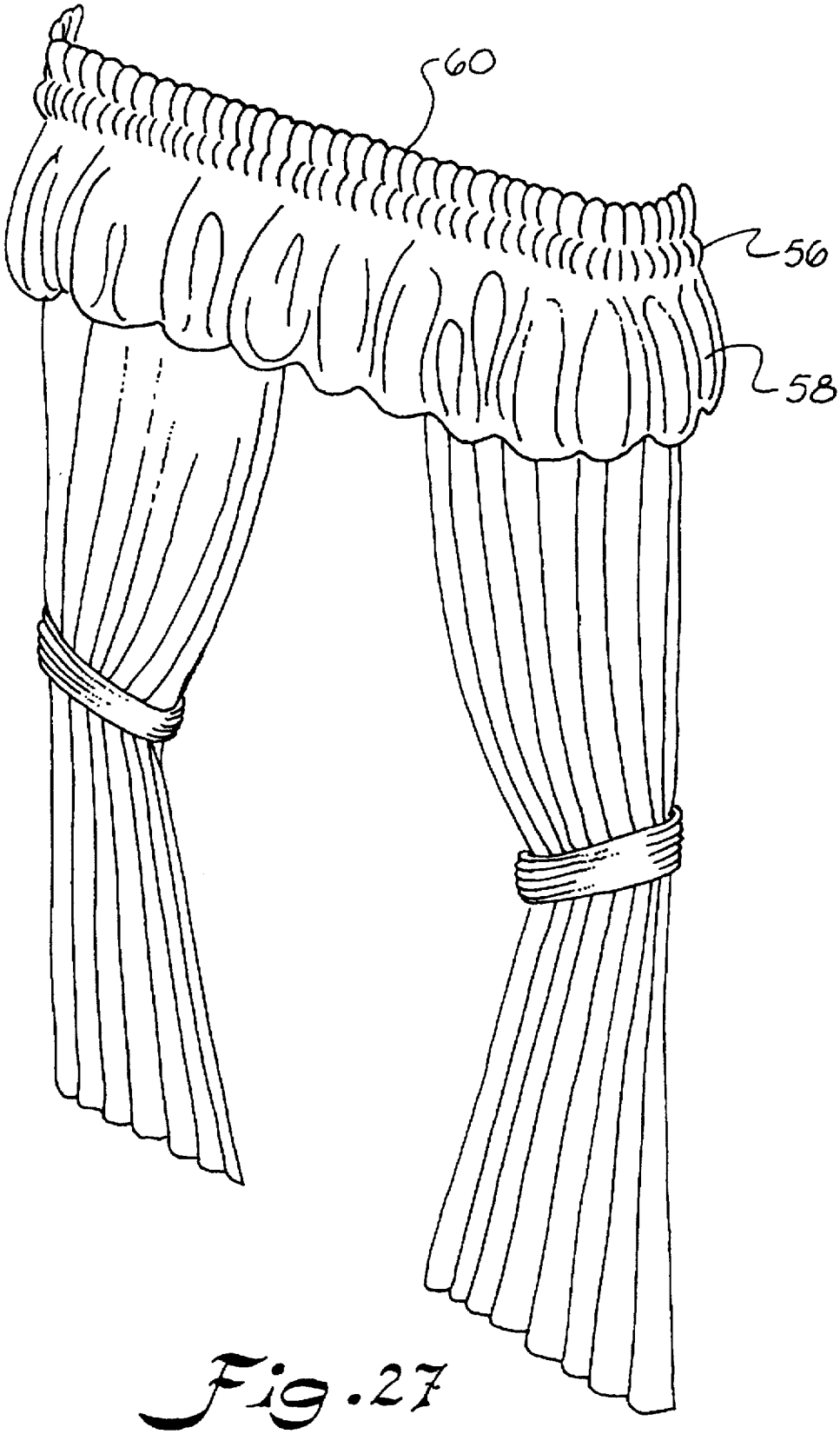
FIG. 27 is a perspective view illustrating a valance that was sewn automatically on the apparatus of the present invention.
Figure 28:
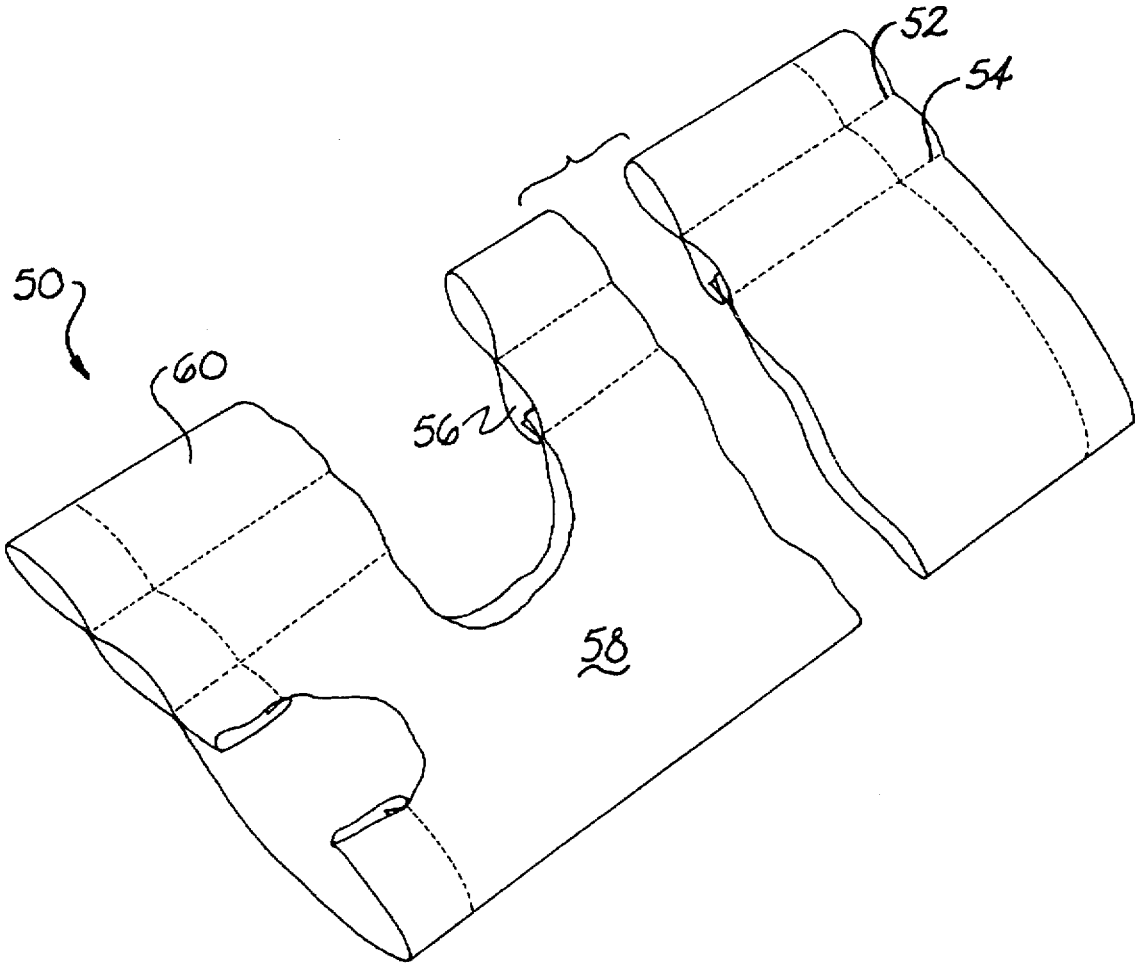
FIG. 28 is a perspective view with parts broken away for the purpose of clarity illustrating a sewn valance.

Before describing in detail the operation of the cloth cutting and sewing apparatus, one's attention is directed to a valance such as shown in FIGS. 27 and 28 that can be produced automatically on the apparatus. As can be seen, the valance 50 is produced from a predetermined length of fabric that is folded over and has a hem 52 sewed along its length. Another seam 54 is sewn longitudinally the length of the valance. As a result, a socket 56 is produced in the valance for receiving the conventional curtain rod holder and a pocket 58 is provided in the valance which can be stuffed with any suitable material to bulk up the valance if desired.

As shown in FIG. 27, when the valance is mounted over a window it has a header portion 60 located directly above the socket 56 through which the curtain rod extends. The valance can be gathered together to any degree to make the final position and design of the valance aesthetically pleasing.

Referring now to FIG. 1, the let off A may be any suitable conventional let off that allows the cloth to be unrolled from a large roll of cloth such as 10 and supplied under a uniform tension to a working table.

Figure 2:
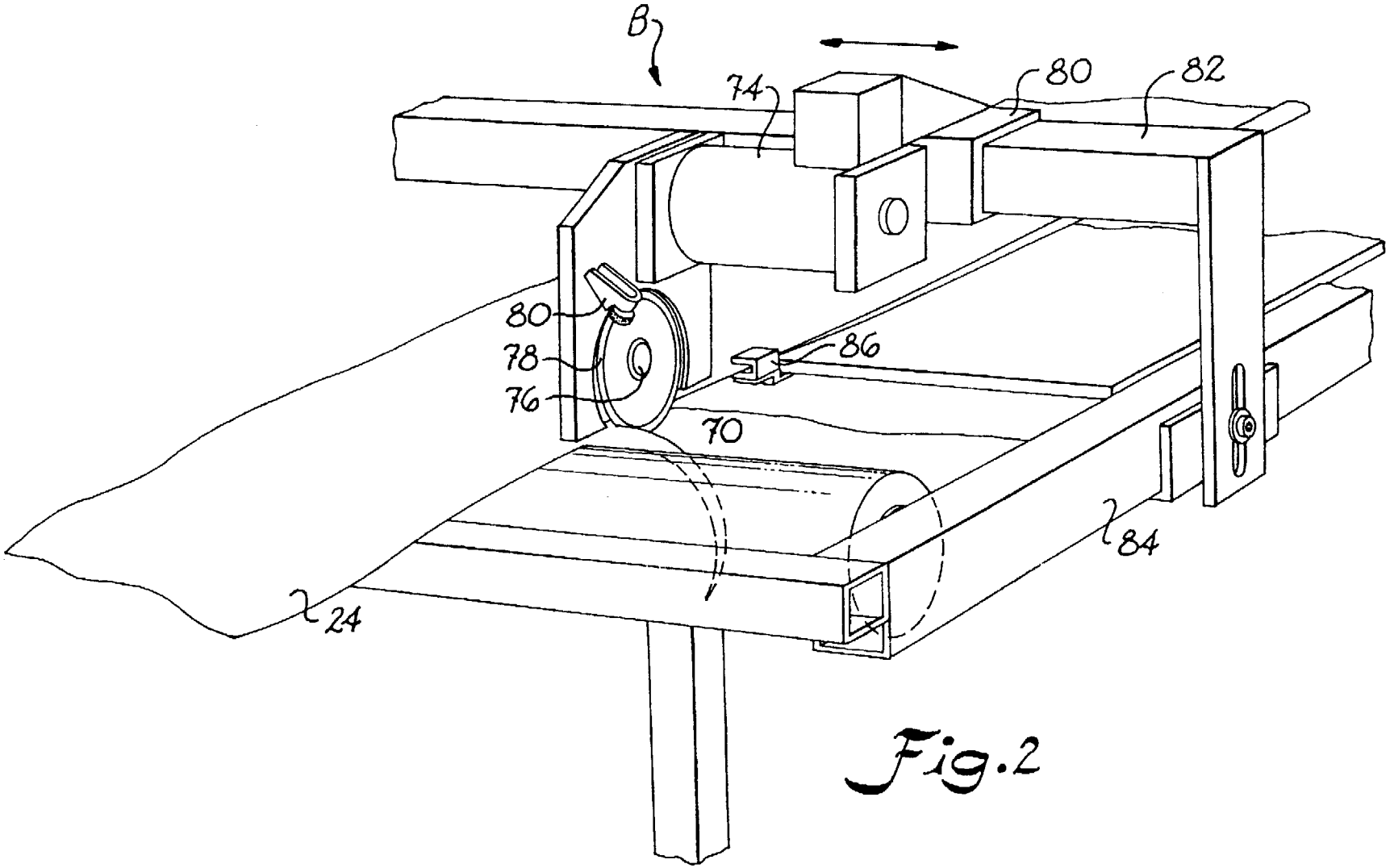
FIG. 2 is an enlarged perspective view illustrating a cutting head used for cutting the edge of a fabric.

One particular cutter B that can be used for cutting an edge 70 off of the cloth is shown in FIG. 2. It includes a motor 74 which can be energized by any suitable source of power that is in direct engagement with a shaft 76 which carries a rotating cutting disc 78. As the cloth 24 moves under the disc 78, it severs the cloth. In order to make the cut produced by the rotating disc cleaner, a carbide block can be placed closely adjacent the lower edge of the blade so that the cloth is severed by the outer edge of the blade pressing against the carbide block. An edge sharpener 80 can be carried adjacent to the cutting edge of the blade for being brought into engagement when desired to sharpen the blade 78. The blade assembly and motor 74 is mounted on a carriage 80 which can be shifted laterally on a cross-support bar 82 that is in turn supported on the frame 84 of the table. As a result, the width of the cloth can be adjusted by moving the cutting head B laterally onto the cross bar 82.

As the edge of the cloth 24 is severed by the cutting blade 78, it then passes between a channel shaped member 86 which maintains the edge of the cloth straight during the severing operation by the blade.

After the cloth passes through the channel shaped member 86, it is fed to the edge folding and positioning station C. The edge folding and positioning station C is shown in greater detail in FIGS. 3 and 4. The purpose of the edge folding and positioning station C is to properly and uniformly fold both edges of the fabric so that a straight and uniform width hem can be subsequently sewed into the edges of the cloth. The location of the inner edge 90 of the cloth is sensed by a pair of photoelectric sensors 92 and 94. As long as the edge of the folded cloth is positioned in between the sensors 92 and 94, no signal is generated to rotate an adjusting wheel 96. As a result, a uniform width fold is produced in the edge of the cloth for subsequently hemming.

If the width of the fold is too great, then both of the photosensors 92 and 94 will be activated. When such occurs, a signal is generated and fed to an electric motor or any other suitable type motor 98 through conventional control circuitry. When the motor 98 is in turn activated, it rotates the wheel 96 clockwise. This clockwise motion of the wheel 96 causes the edge 90 of the cloth 24 to move outwardly. After a short delay, photosensors 92 and 94 are again activated for sensing the edge 90 of the cloth 24. If the cloth is not properly aligned at this point, the wheel 96 is rotated further. If inner edge 90 is properly aligned between sensors 92 and 94, no further adjustments are needed, and wheel 96 assumes a straight path.

If on the other hand the folded edge 90 is not wide enough and does not come between under each of the photosensors 92 and 94, then the wheel 96 is rotated in the counterclockwise direction similar to as described above to guide the edge 90 of the fabric back between the photosensor cells.

The photosensor cells 92 and 94 include a light source positioned under the fabric and a sensor positioned on a space member. The fabric moves between the light source and the two sensor heads and operates in the conventional manner.

Figure 4:
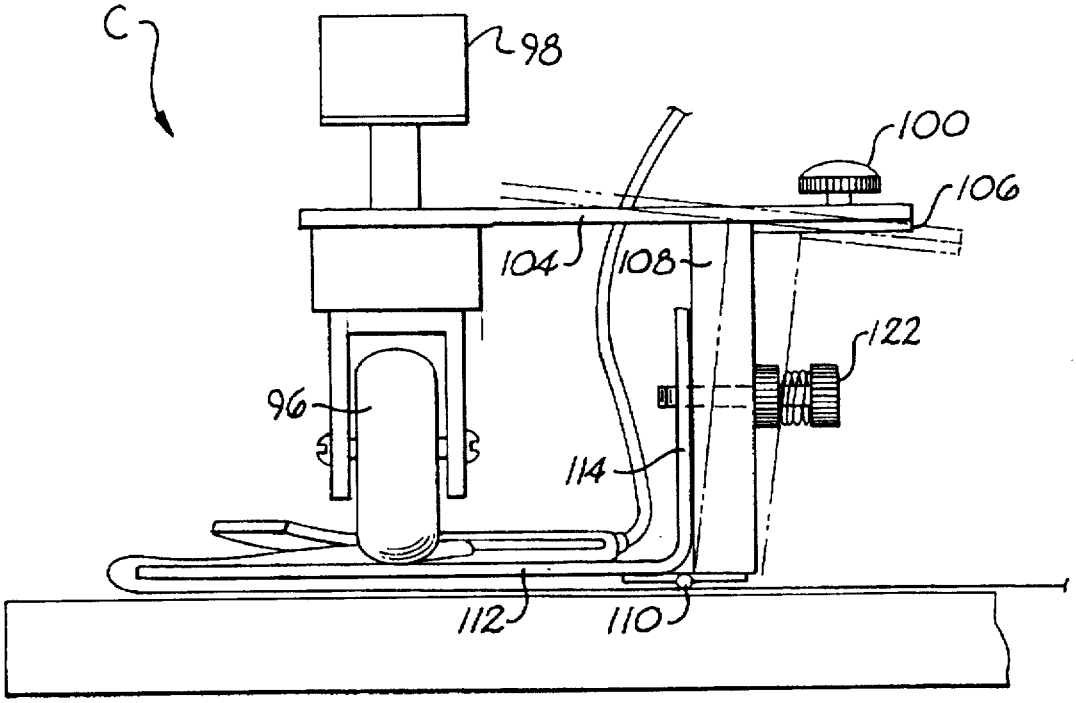
FIG. 4 is an end view of the edge aligning and locating device.
Figure 5:
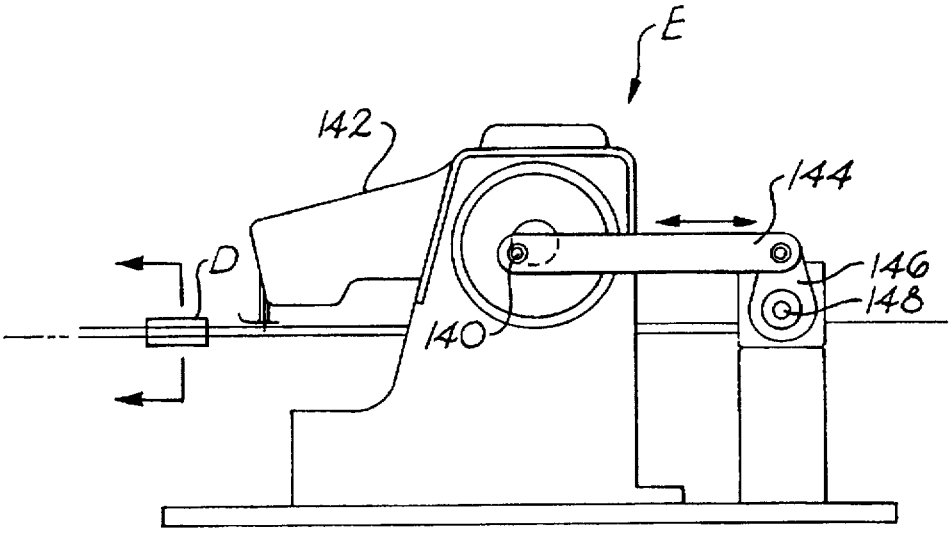
FIG. 5 is an elevational view illustrating one of the sewing machines used for sewing the hem on one side of the fabric.

The position of the wheel 96 can be physically adjusted by loosening a screw 100 that is carried within an elongated slot 102 provided in a bracket 104. The screw extends into a horizontal supporting plate 106 which is in turn carried on top of support block 108. As can be seen in FIG. 4, the support block 108 is in turn hinged adjacent its lower end through a hinge 110 to a fold forming plate 112.

Figure 3:
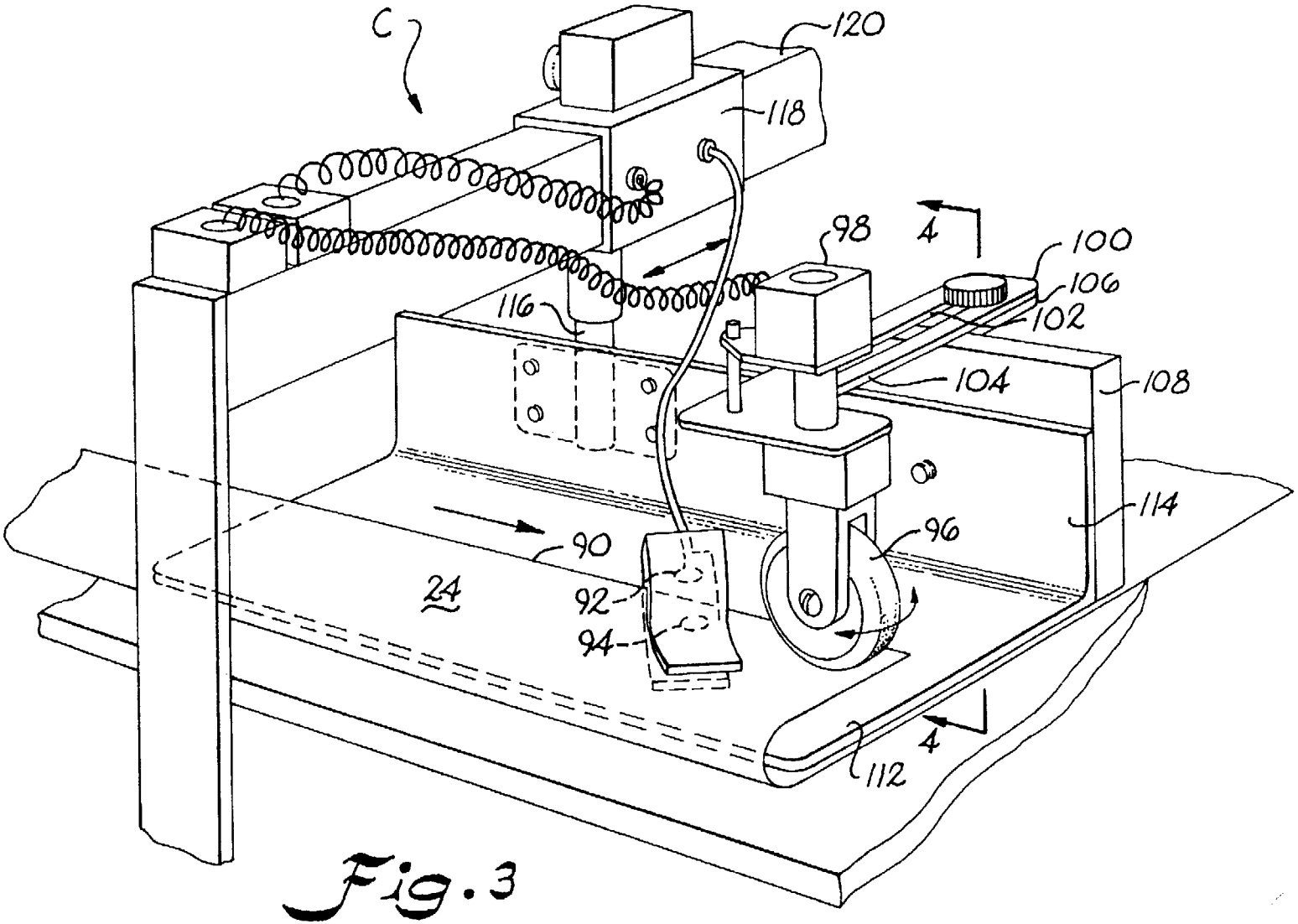
FIG. 3 is an enlarged perspective view illustrating an edge folding and positioning device.

The fold forming plate 112 has a vertically extending flange 114 that is in turn fixed to a vertical shaft 116 as shown in FIG. 3 that is in turn carried on a slidable tubular member 118. The slidable tubular member 118 is carried on a square horizontally extending tubular member 120. As a result, the horizontal or lateral position of the entire edge folding and positioning station C can be adjusted.

A spring loaded screw 122 extends between the support block 108 and the vertical flange member 114 for applying a predetermined pressure through the wheel to the cloth during its guiding operation. As can be seen in FIG. 4, the entire wheel assembly including the wheel 96 and the motor 98 can be pivoted slightly about the hinge 110 for controlling the pressure asserted on the cloth during the guiding operation.

Figure 6:
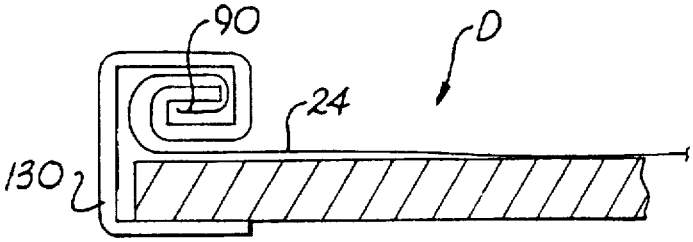
FIG. 6 is a sectional view illustrating the curl and double folded hem produced on the edge of the fabric.
Figure 7:
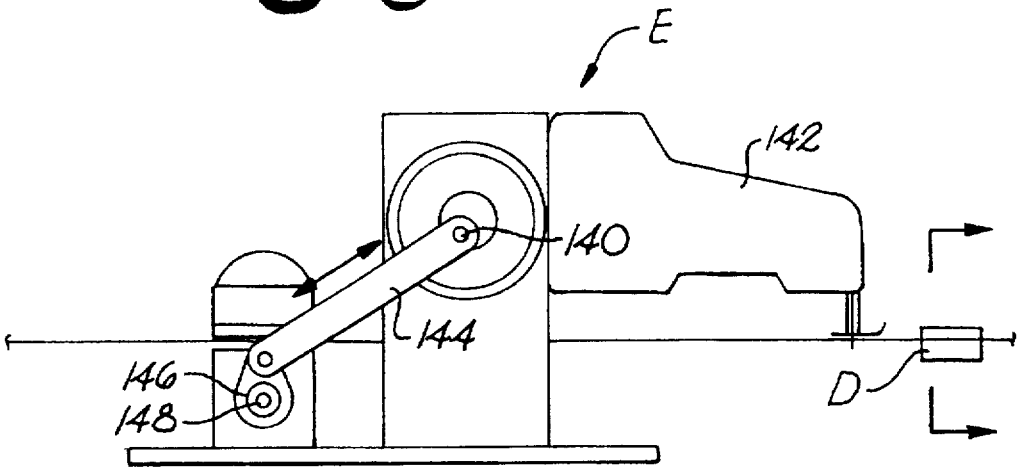
FIG. 7 is an elevational view illustrating a sewing head positioned on the opposite side of the fabric from the sewing head of FIG. 5.

After the cloth passes under the edge folding and positioning station C, it then moves through a conventional hem edge curler D such as shown in cross-section in FIG. 6. The hem edge curler D includes a spherically twisted piece of sheet metal 130 that curls the cloth 24 into a double fold adjacent its leading edge 90 such as best shown in FIG. 6. Such is a conventional hem forming mechanism. Once the fold is placed in the edge of the cloth 24, it then passes under a hem sewing head and cloth advancer E as shown in FIGS. 5, 7, 8, and 9. At this point on the table, the cloth has been advanced or moved forward by the cloth advancer E.

The hem sewing head 142 is a conventional sewing head that sews the hem into the edge of the cloth once it is folded by the folder D.

Coupled to the shaft 140 of the sewing head 142 is an eccentrically mounted linkage 144. This linkage in turn is connected off center to a shorter linkage 146 that is in turn carried on a shaft 148.

During the sewing operation, the upper shaft 140 of the sewing machine runs continuously. As a result of the linkage 144 being eccentrically attached to the shaft, a reciprocating motion is imparted to the linkage member 144. Such is shown by the arrow 150 in FIG. 8. This reciprocating motion is in turn imparted to the shaft 148 which has a sprague clutch mounted therein which permits rotation to take place in one direction. The output of the sprague clutch is connected to an advancing roll 152 that engages the surface of the cloth 24 for pulling the cloth through the sewing head and across the table described previously.

The purpose of intermittently pulling the cloth through the sewing head is for not pulling the cloth when the needle is in the cloth. In other words, the material is only pulled when the needle comes out of the cloth. Thus, the feed roll 152 advances the cloth a predetermined distance in synchronicity with the sewing machine. A second roller 154 is positioned in tandem with the drive roller 152 and is in pressure engagement therewith so that when the drive roll 152 is rotated it causes the cloth 24 to be advanced therebetween.

Figure 8:
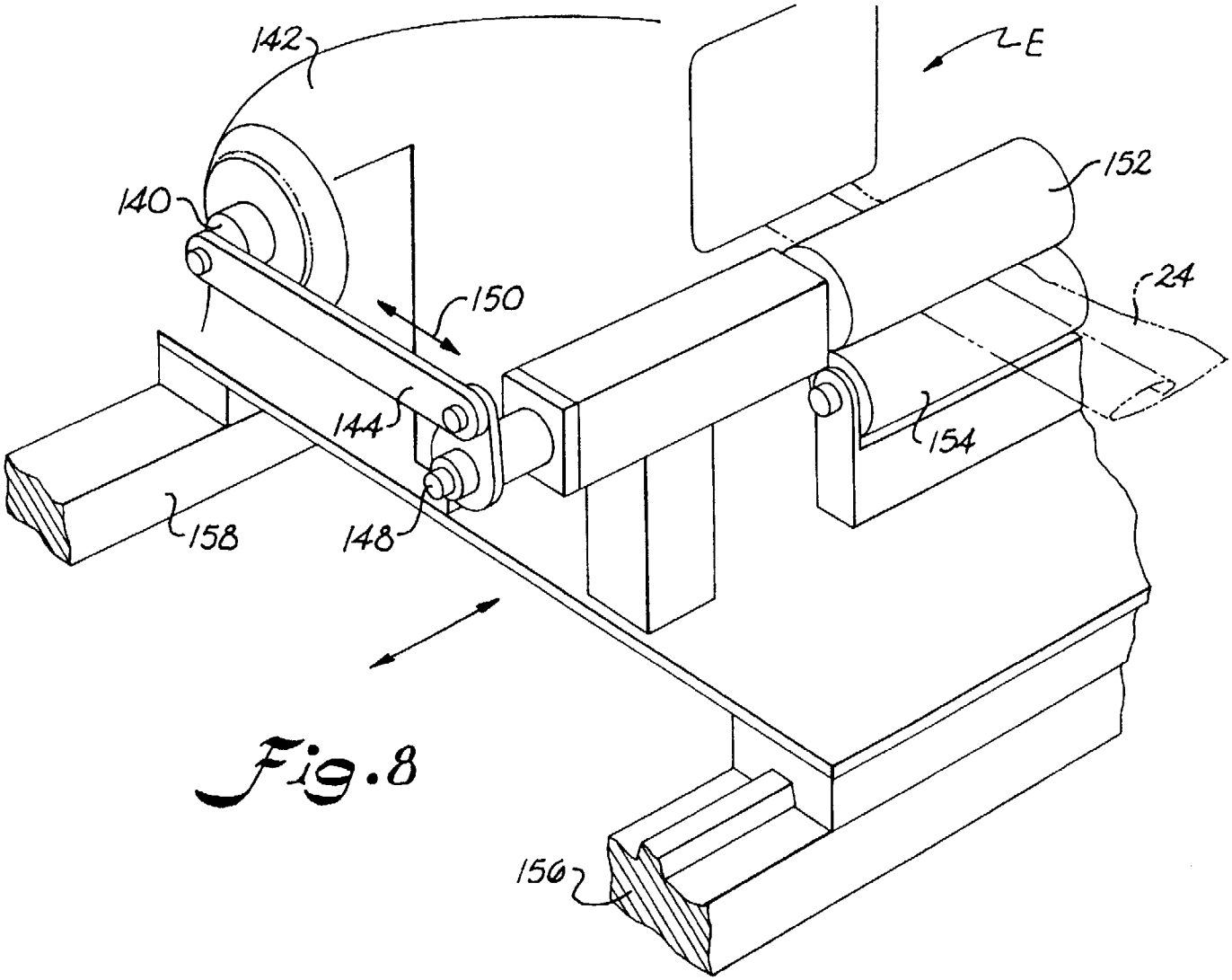
FIG. 8 is an enlarged perspective view illustrating one of the sewing heads used for sewing the hems into the fabric.

As shown in FIG. 8, the sewing head E is carried on laterally extending guide rails 156 and 158 so that its position can be adjusted for accommodating and sewing cloth of various widths.

As a result of using a sprague clutch to the output of shaft 148 instead of a ratchet, the clutch will give infinitesimal adjustable intermittent forward movement through the cloth as compared to a ratchet which would be controlled by the spacing between the individual teeth. The principle of moving in one direction is analogous to a ratchet operation but by operating through a sprague clutch one can adjust the forward stroke.

Figure 9:
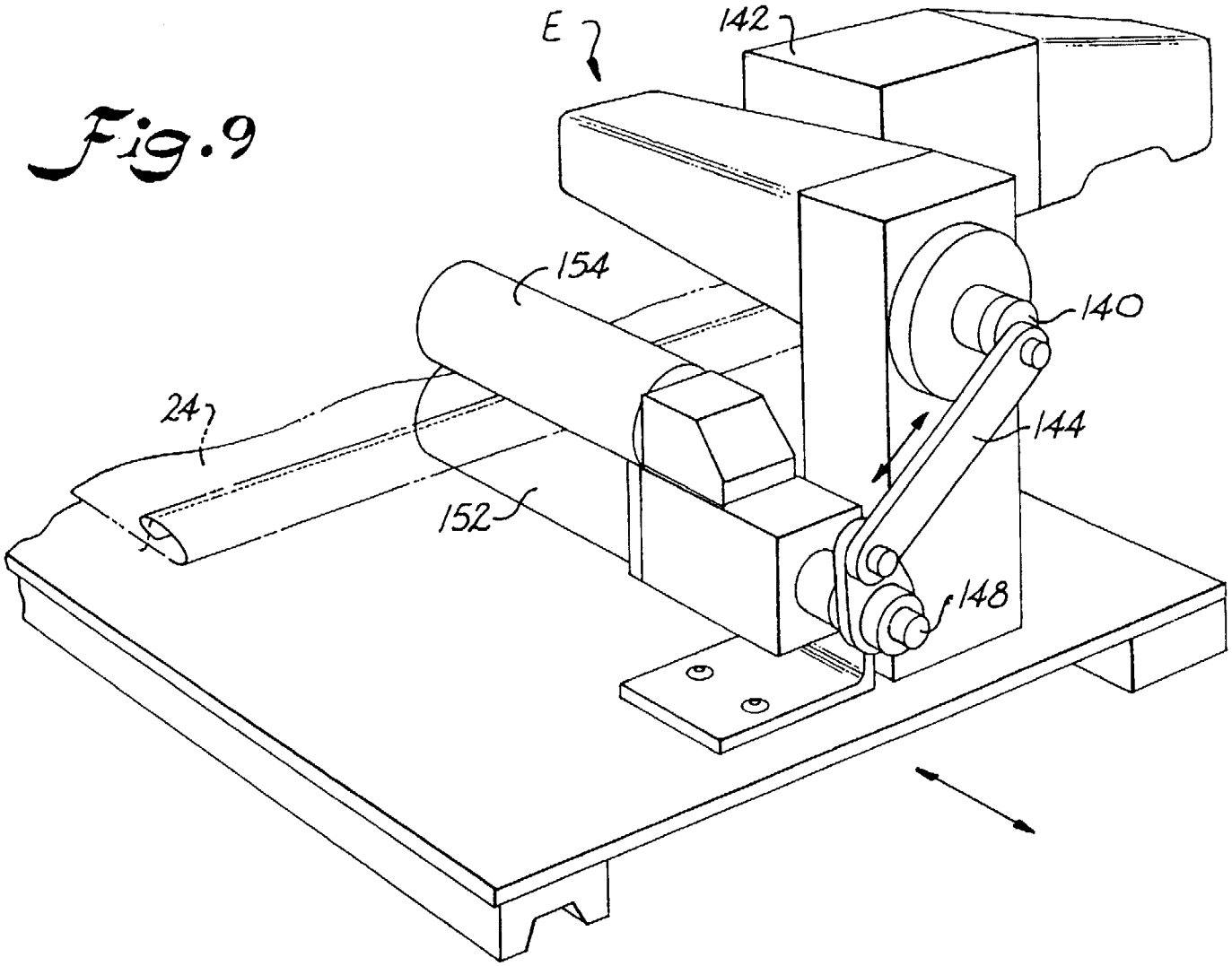
FIG. 9 is a perspective view illustrating another embodiment of the sewing head of FIG. 8.

In FIGS. 8 and 9, two embodiments of a sewing head and cloth advancer E are shown. In particular, in FIG. 8 the drive roller 152 is located above second roller 154. In FIG. 9, on the other hand, drive roller 152 is located below the second roller 154. Either embodiment can be used in the apparatus of the present invention. However, for most conventional sewing heads such as 142, preferably the drive roller is located below the static roller for smoother operations. Of course, depending upon the equipment used or the particular circumstances, drive roller 152 can be placed in either position.

After the cloth 24 passes under the hem sewing head and cloth advancer E it is then fed into the accumulator F as shown in FIG. 1. The weight of the roll 30 pulls the cloth down into the accumulator to accumulate a reserve of cloth.

The cloth extends around the bottom surface of the roll 30 and up on top of the length cutting table where a length cutter G has previously severed the cloth. At the cutting table, the cloth is being held in place by means of a brush like member 170. The brush like member 170 extends entirely all the way across the frame. The angles of its bristles 172 point in the forward direction, in the direction of the cloth, so that the cloth can pass easily thereunder. However, brush member 170 prevents the cloth from being pulled backwards into the accumulator once the edge of the cloth has been severed by the length cutter G.

Figure 10:
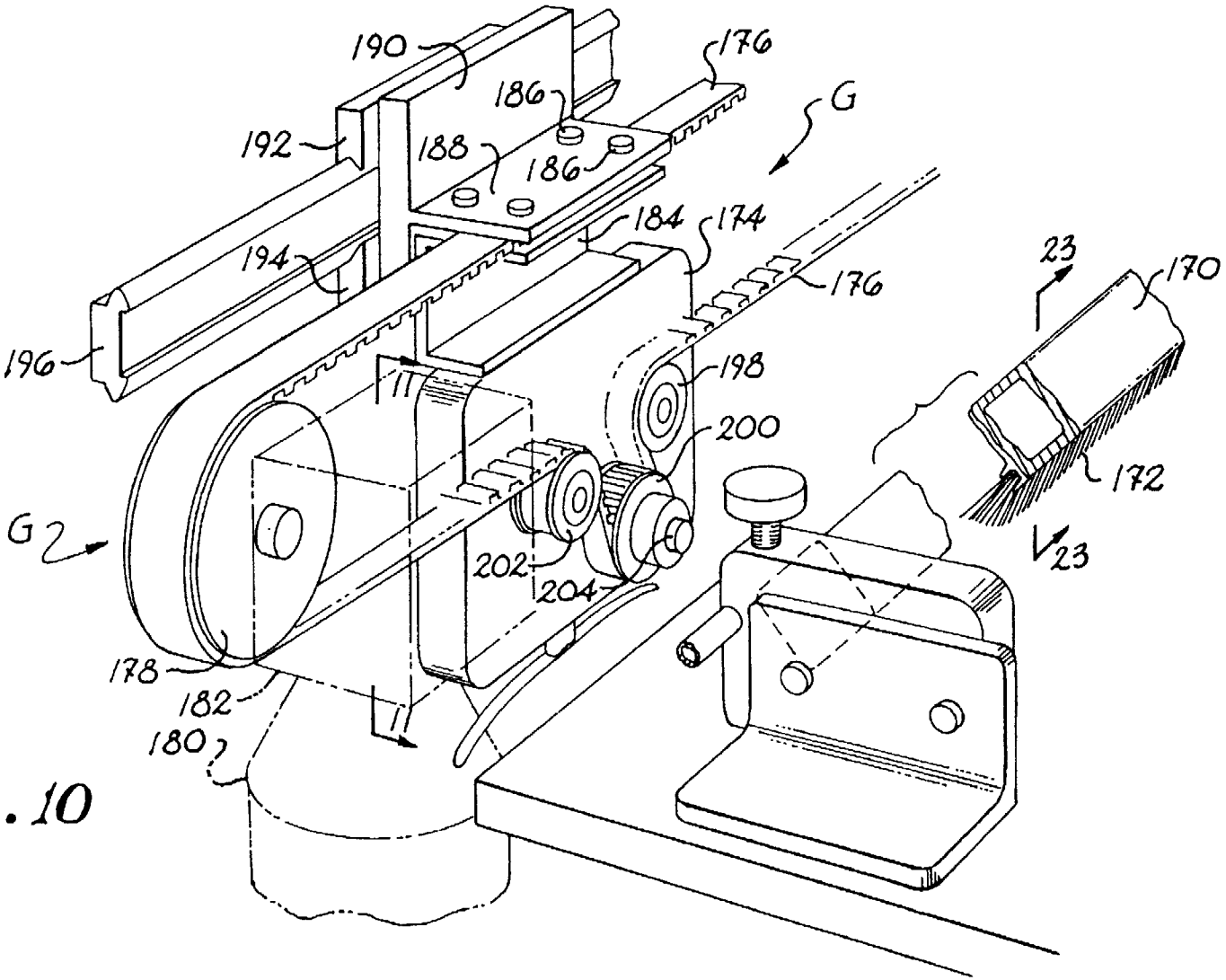
FIG. 10 is a perspective view of a movable cutter which is used for cutting the cloth into predetermined lengths.
Figure 23:
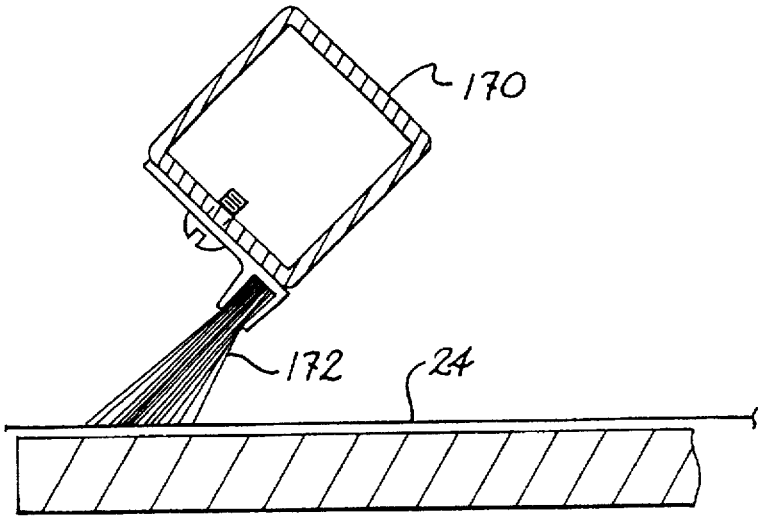
FIG. 23 is a cross-sectional view illustrating a gripping device for gripping and retaining the cloth prior to the cloth being cut into predetermined lengths.
Figure 11:
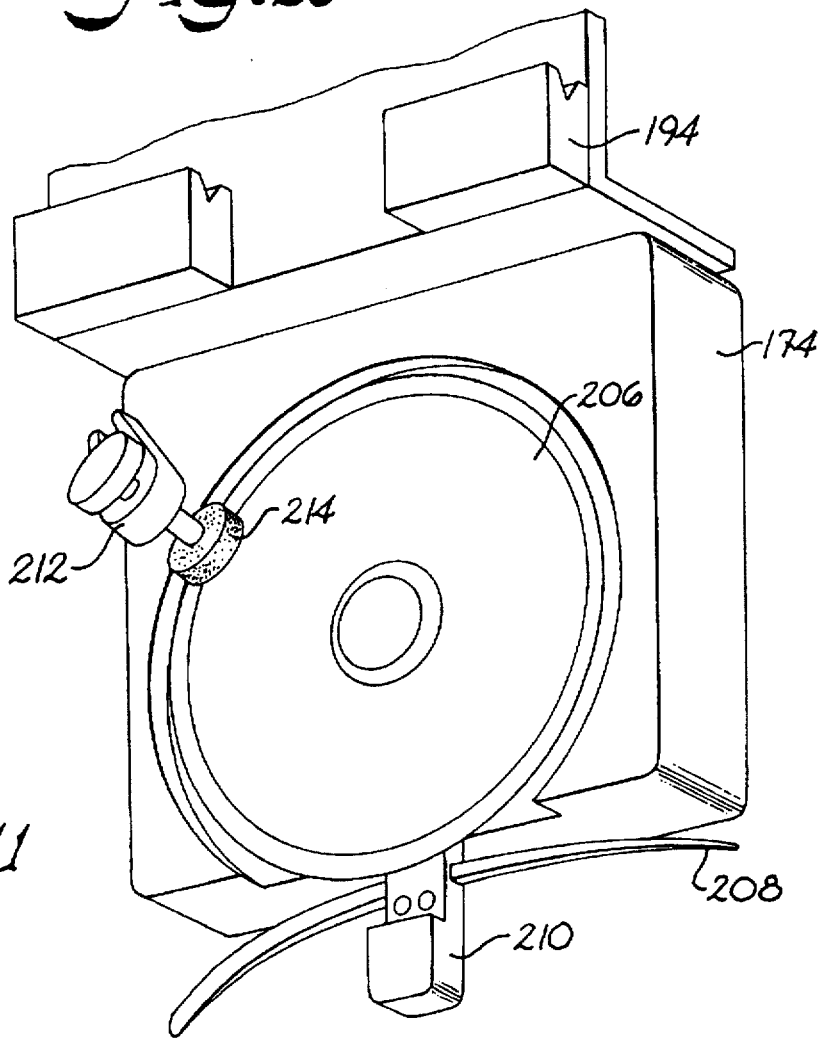
FIG. 11 is an enlarged perspective view illustrating the cutter head from part of the cutter of FIG. 10.

The length cutter G is shown in greater detail in FIGS. 10 and 11. It includes a cutting head 174 that is propelled back and forth across the cutting table by a gear tooth belt 176 that is driven by a driven pulley 178. The pulley 178 is driven by a conventional electric motor 180 through a gear box 182 which is shown in broken lines in FIG. 10 so as not to obscure the remaining parts of the drawing. The cutting head is carried on a channel shaped bracket 184 that is in turn attached to the gear tooth belt 176 by means of bolts 186 which extend through a plate 188. The channel member 184 is in turn attached to a supporting block 190 that has a pair of spaced guide channels 192 and 194 attached thereto. The pair of spaced guide channels are in turn supported on a rail 196. The guide channels 192 and 194 are made of a self-lubricating material such as high molecular weight polyethylene so that the cutting head can be readily reciprocated back and forth across the machine during the cutting operation.

The timing belt 176 extends around a roller 198 which guides the belt around a geared roller 200 for driving the gear roller 200. The belt then extends up around another idle roller 202. As a result, as the belt is driven by the drive roller 178, the cutting head moves back and forth across the cutting table. As it moves back and forth across the cutting table, the gear roller 200 is rotated. The gear roller 200 is fixed to a shaft 204. The other end of the shaft 204 has a circular cutting blade 206 secured thereto.

A leaf spring 208 is carried adjacent to the lower end of the cutting head and the blade 206 so that it passes under the cloth during the cutting operation and guides the cloth into engagement with the rotating edge of the blade 206. A carbide cutting block 210 is positioned adjacent to the bottom edge of the cutting blade 206 so as to make a clean severance of the cloth as the cutting head traverses back and forth across the machine.

The cutting head has a sharpening device 212 mounted thereon so that when a sharpening head 214 is brought into engagement with the rotating blade, it sharpens the edge of the blade at a proper angle.

The guide rail 196 upon which the length cutter G is carried extends entirely across the cutting table and is supported by its ends by any suitable standards.

As shown in FIG. 1, the cloth puller and leading edge folder device H is provided for pulling a predetermined length of cloth from the accumulator across a folding table 8 so that the length of the cloth can be cut by the length cutter G. The cloth puller has a gripping jaw that can be closed over the edge of the cloth that was cut by the length cutter. Once the cloth puller H engages the edge of the cloth, it can be retracted for pulling a predetermined length of cloth from the accumulator F.

Figure 12:
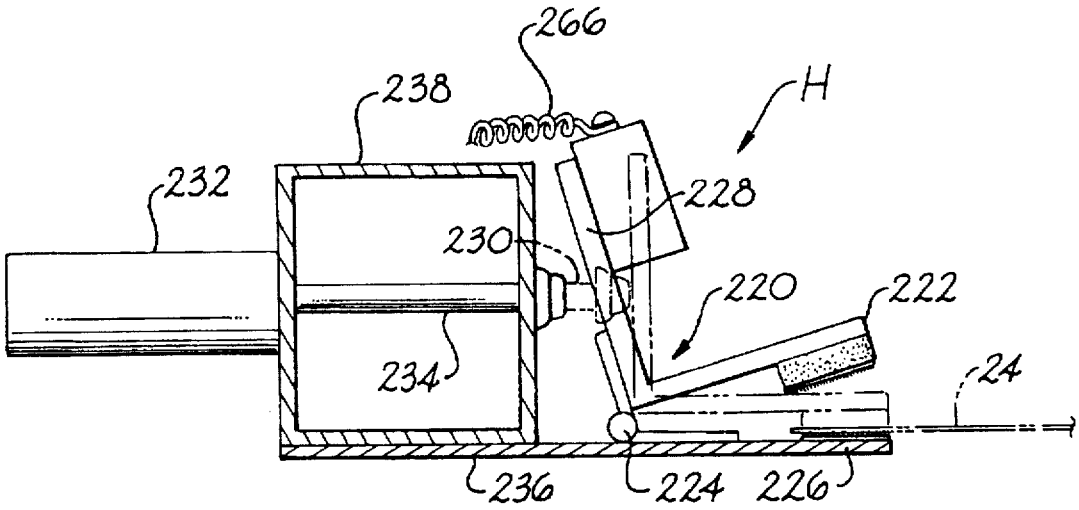
FIG. 12 is a cross-sectional view of a movable gripping head carried on the cloth puller shown in more detail in FIG. 21.
Figure 21:
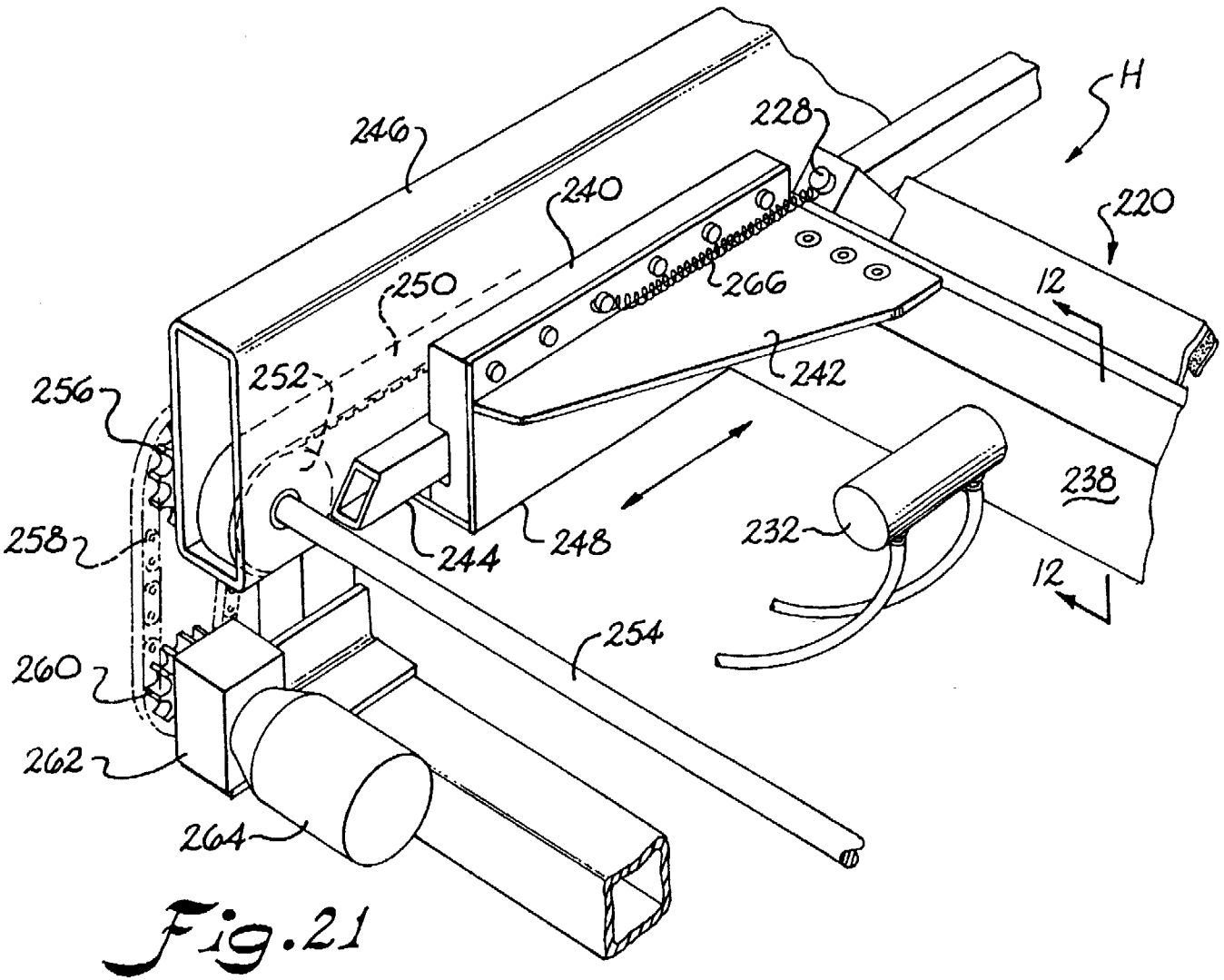
FIG. 21 is an enlarged fragmentary perspective view illustrating a portion of the cloth pulling device.

The cloth puller H as shown in FIGS. 12 and 21 includes a pivoting gripping jaw 220 that has an upper movable flange member 222 that is hinged at hinge joint 224 that can be pivoted downwardly to a closed position to grip the leading edge of the cloth 24 with a cooperating jaw 226 located therebelow. The gripping jaw has a vertically extending flange 228 connected thereto so that when the flange is pushed forward by a plunger 230 to a vertical position, the gripping jaw 220 will be pushed down to grip the cloth. The plunger 230 is carried on the output of a pneumatically operated cylinder 232 that has a piston 234 extending therefrom. The hinge member 224 is supported on a base plate 236 that is in turn secured to a tubular member 238. The tubular member 238 is in turn supported on spaced slide blocks 240 constructed of lubricated high molecular weight polyethylene material. Angle members 242 secure the tubular member 238 to the side block 240. Side blocks 240 are carried on opposite sides of the frame as only one side of the cloth puller H is shown in FIG. 21. The slide blocks 240 are in turn carried on a tubular rail 244 that is suitably supported on side frame members 246. The guide blocks 240 have a metal support plate 248 attached to the bottom thereof which are in turn attached to a timing belt 250. The timing belt 250 extends around spaced driven pulleys 252. One of the pulleys 252 is supported on a rotatable shaft 254. The upper end of rotatable shaft 254 has a gear 256 provided thereon. The gear 256 is in turn coupled by a chain 258 to a grip driven gear 260. The driven gear 260 is coupled to the output of a gear box 262 which has its input connected to a motor 264. By turning the motor 264 on and off, the gripping jaw 220 can be moved along the guide rail 244 to a position closely adjacent the previously cut end of the cloth for gripping the cloth. Once the gripping jaw 220 is engaged to grip the cloth, it can be retracted to pull a predetermined length of cloth from the accumulator.

A spring 266 extends from a vertically extending portion 228 of the jaw and the slide block 240 to hold the jaws in a normally open position. In order to close the jaw 220, air is supplied to the pneumatic cylinder 232 to move the piston to the right, as shown in FIG. 12. When the piston 234 is moved to the right, the plunger 230 engages the vertically extending portion of the upper jaw to pivot it about the hinge 224 to cause the horizontal gripping jaw 222 to move to the closed position where it would engage the cloth.

Figure 13:
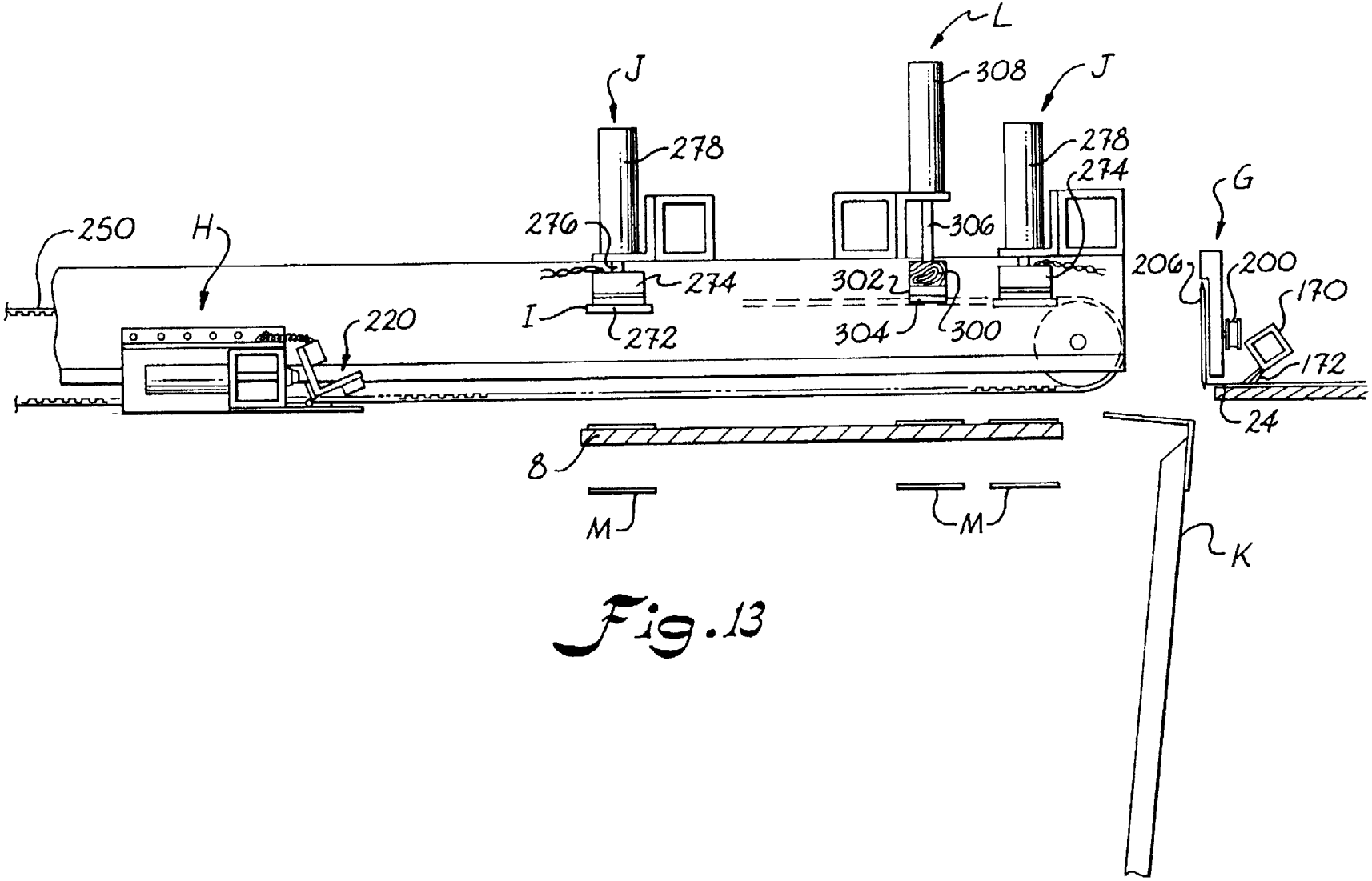
FIG. 13 is an end view partially in section illustrating a portion of the folding table and the cloth pulling mechanism.
Figure 22:
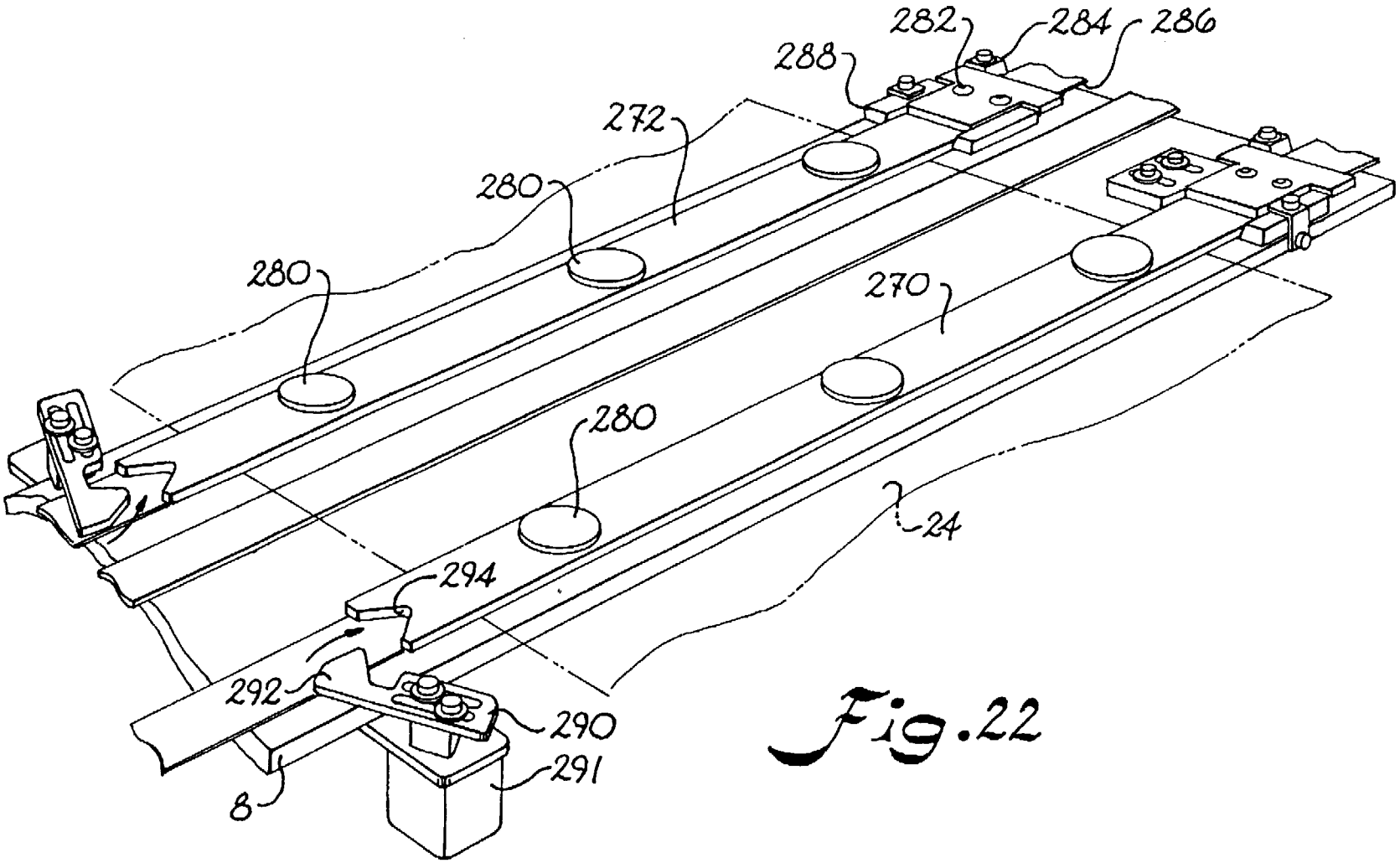
FIG. 22 is an enlarged perspective view illustrating a pair of dies used for holding the cloth down on the folding table during the folding operation.
Figure 24:
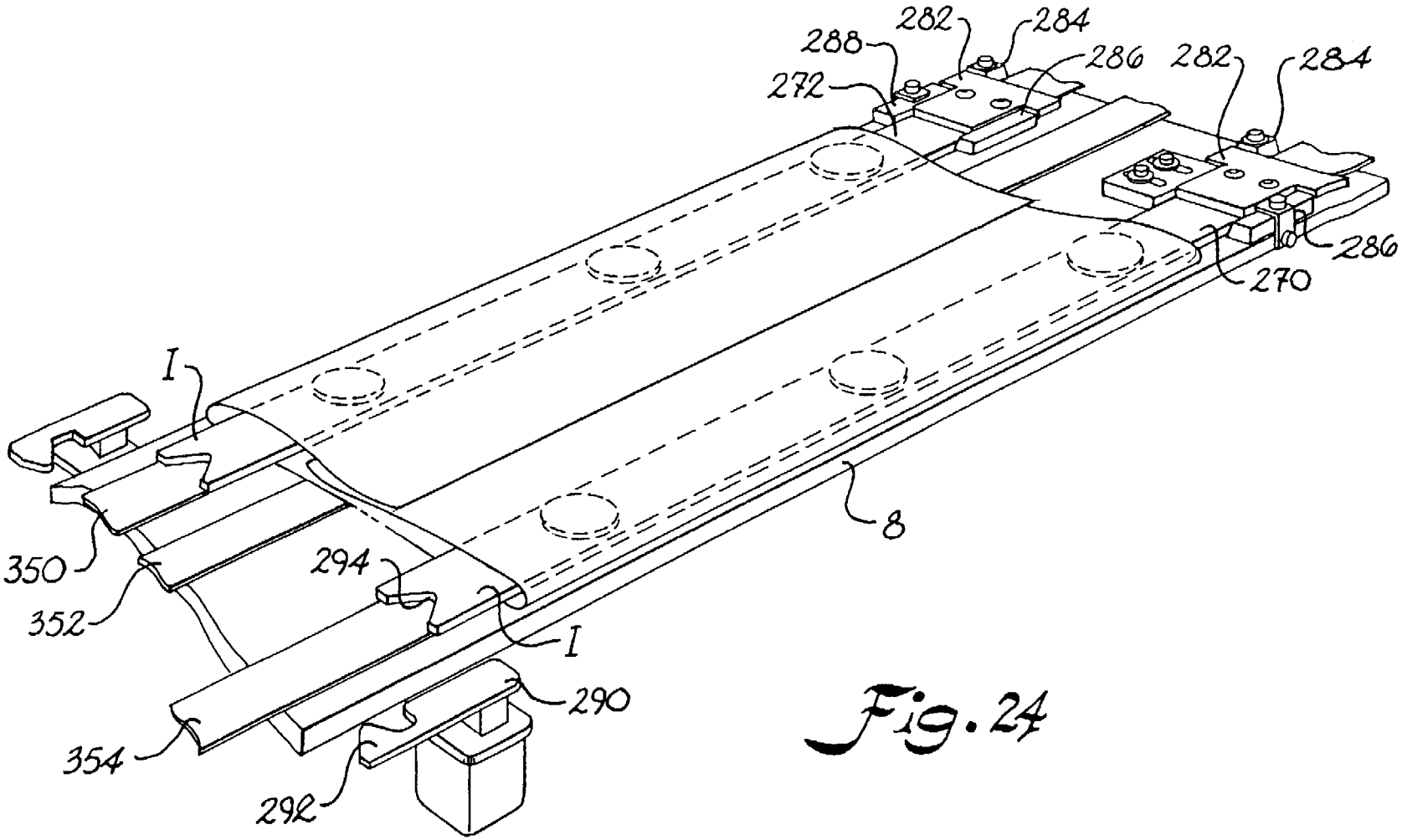
FIG. 24 is an enlarged perspective view illustrating the folded cloth on the folding table prior to sewing.

Before describing the sequence of operation of the pulling head and the folding of the cloth on the folding table, the dies for facilitating the folding of the cloth will be described. The dies include two elongated metal plates 270 and 272 such as best shown in FIGS. 22 and 24. The dies are placed on top of the cloth 24 after the cloth 24 has been pulled onto the folding table 8. The dies are raised and lowered by lifting devices J. The lifting devices J as shown in FIG. 13 include an electrical magnet 274 carried on the end of a piston rod 276 extending out the lower end of a pneumatically operated cylinder 278. The die plates are raised and lowered from the lifting table by manipulating the pneumatically operated cylinders 278. In order to lower the die onto the cloth carried on the table, air is supplied to an upper port of the pneumatic cylinder 278 forcing the piston rod 276 out the lower end of the cylinder. The electromagnet 274 is energized at this time and has the metal die 272 secured thereto. When the die is positioned on top of the cloth, the electromagnet is deenergized releasing the die 272, and the pneumatic cylinder 278 has air supplied to its lower port for raising the piston with the electromagnet upwardly so as not to interfere with the folding operation.

There are three electromagnets positioned above each of the dies for engaging metal plates 280 carried on the dies.

In order to ensure that the dies are properly positioned on the folding table, a T-shaped attachment 282 is carried on one of the ends of each of the dies. The T-shaped attachment is positioned between three abutments 284, 286, and 288, which properly align the end of the die on the folding table 8. Aligning members 290 are provided adjacent to the other end of the dies and include a triangular shaped end portion 292 that is rotated into engagement with a V-shaped recess 294 provided on the end of the dies opposite the end where the T-shaped member 282 is carried. The positioning member 290 is carried on the end of an output shaft of a motor 291 that when energized rotates the engaged member 290 from a retracted position such as shown in FIG. 22 to a positioning position wherein the triangular shaped end portion 292 engages the V-shaped slot 294 to properly align the dies. The T-shaped attachments 282 and aligning members 290 maintain the dies 270 and 272 in their proper position during the folding operation as will be described hereinafter.

Figure 25:
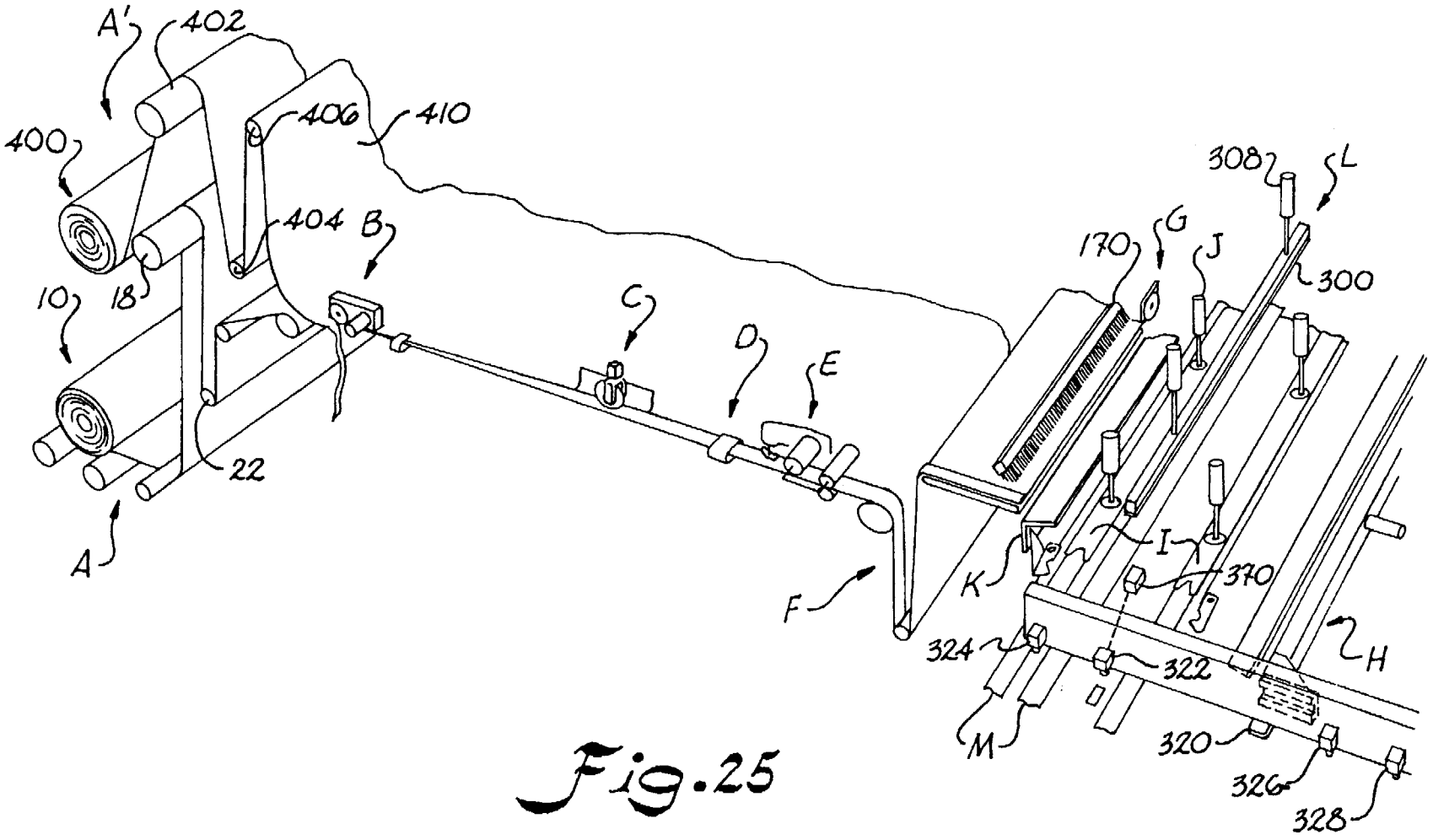
FIG. 25 is a fragmentary perspective view illustrating part of the cloth processing apparatus.

The entire pulling and folding operation of the fabric will be described below, but it is felt that it is best to describe some of the elements that are to be used in the operation before going through the sequences. Another functional device is the cloth hold down device L. The cloth hold down device L as shown in FIGS. 13 and 25 includes an elongated wooden block 300 that extends across the entire folding table 8. Positioned adjacent the bottom of the elongated wooden block 300 is a foam pad 302 that has secured to the bottom surface thereof a strip of high molecular weight polyethylene 304. The elongated block 300 is secured to the lower end of a plurality of pistons 306 that are in turn manipulated by pneumatically operated cylinders 308. The purpose of the cloth hold down bar L is to hold the cloth flush against the folding table when it is desired to transport the folded cloth pattern laterally to a subsequent sewing station. As a result of the foam pad 302, the low friction surface 304 is allowed to ride over seams and hems while imparting a substantially uniform pressure all the way across the cloth. The low friction surface 304 permits the cloth to slide under the hold down device when it is being shifted laterally to a subsequent sewing operation.

Figure 14:
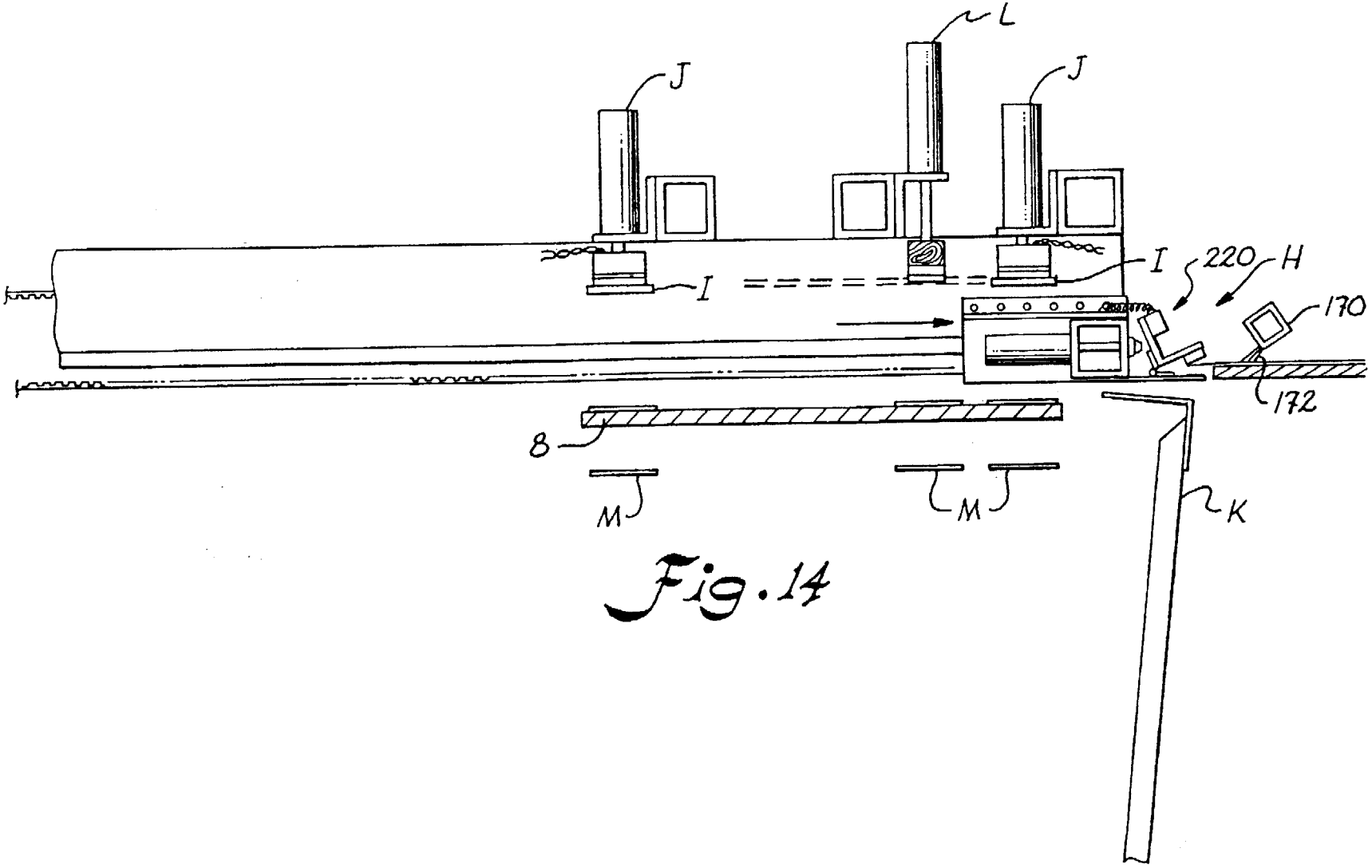
FIG. 14 is an end view illustrating the cloth pulling mechanism in a position immediately prior to gripping the end of the cloth.

This sequence of the pulling and cutting of the predetermined lengths of fabric will now be described. First, reference is directed to FIG. 13 which shows on the right, the edge of the cloth 24 located directly under the cutter blade 206. At this point in time, the cloth puller H is retracted to the end of the machine such as shown in FIG. 13, and the gripping jaw 220 is in an open position. The controller for the machine energizes the drive motor 264 which causes the timing belt 250 to be driven to move the gripping head 220 to the right, to the position shown in FIG. 14. As the gripping head 220 approaches the position shown in FIG. 14, a metal member 320 which is carried by the timing belt 250 and which projects laterally beyond the frame of the machine first passes proximity switch 322 as shown in FIG. 25. At this point in time a signal is generated to slow the motor 264 down. The gripping head 220 continues, however, moving forward until the member 320 is positioned adjacent the proximity switch 324 which generates a signal that is fed back to stop the motor 264 in the position shown in FIG. 14. Note in FIG. 14 that the dies I are engaged with the electromagnets and are in a raised position so as to permit the gripping head to pass thereunder.

Figure 15:
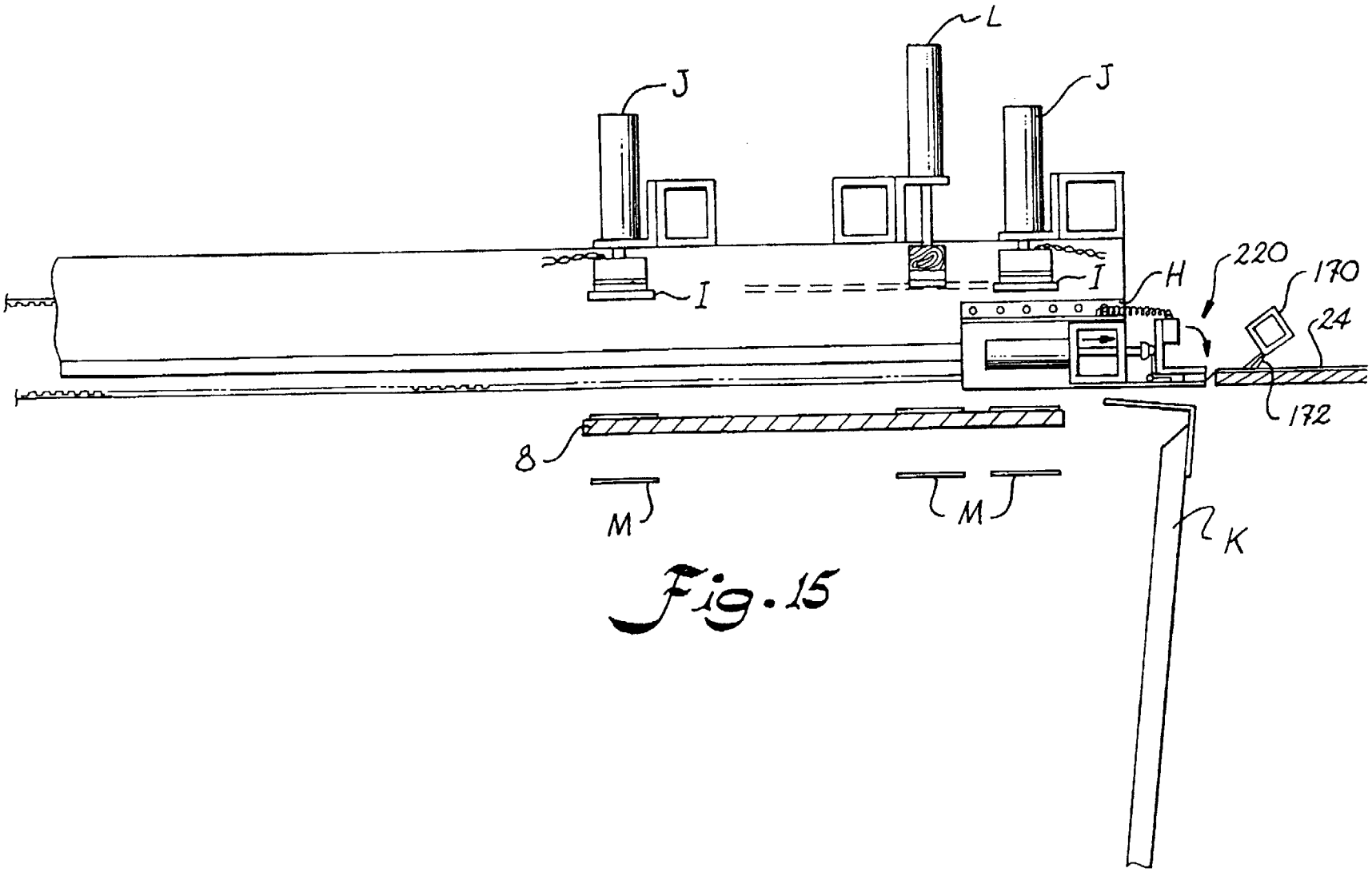
FIG. 15 is an end view partially in section of the cloth pulling mechanism gripping the cloth.

FIG. 15 shows the gripping head 220 lowered to a closed position gripping the leading edge of the fabric 24.

Figure 16:
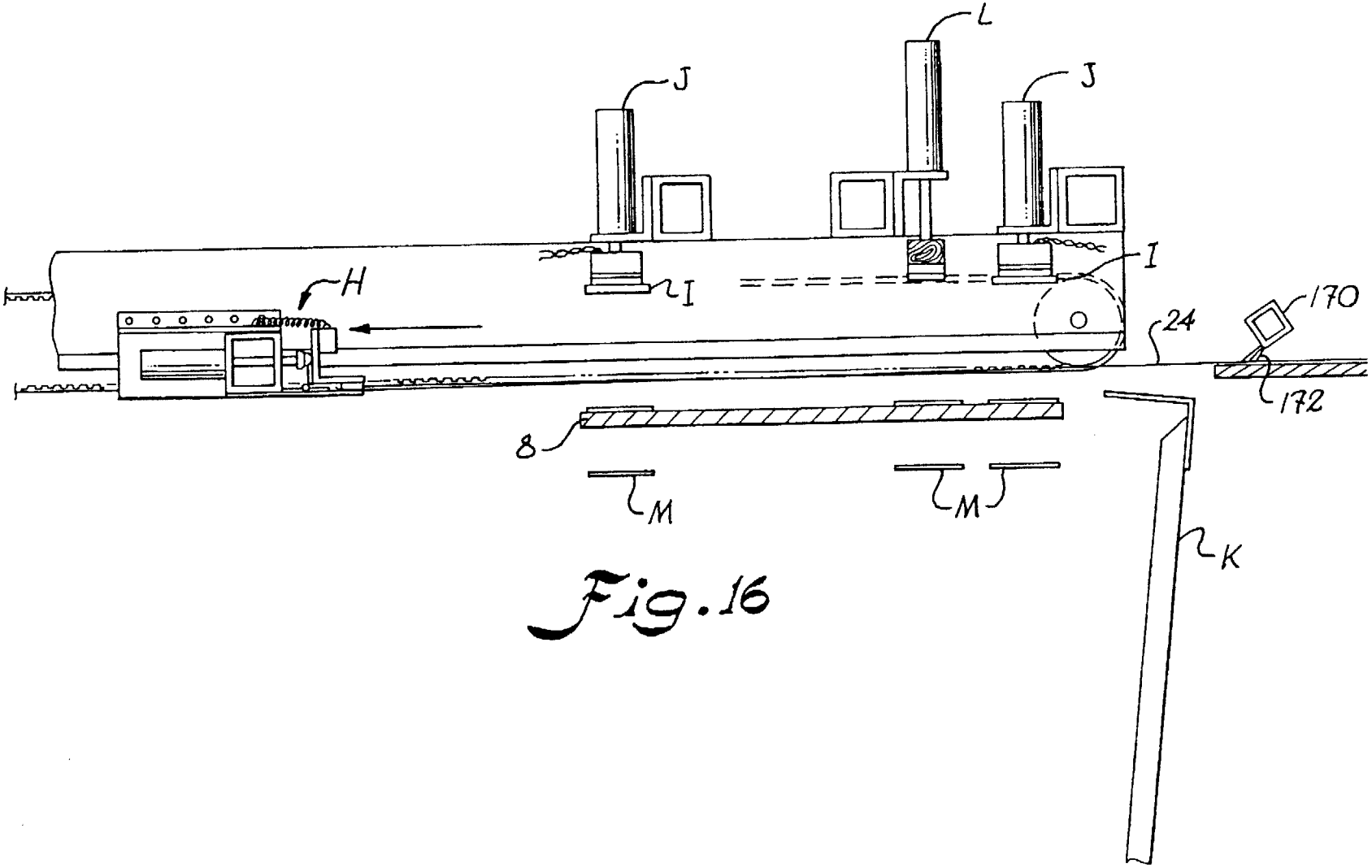
FIG. 16 is an end view of the cloth pulling mechanism after the cloth has been pulled back over the folding table.

In FIG. 16, the controller associated with the machine again energizes the motor 264 to retract the puller H with the gripping head in the closed position pulling the cloth 24 out of the accumulator F. As the activating member 320 carried by the gripping head comes adjacent a proximity switch 326 as shown in FIG. 25, the motor slows down and keeps going backwards until it comes adjacent the proximity switch 328 which stops the motor 264. In this position, the cloth 24 is extended its full length such as shown in FIG. 16. The proximity switches are adjustable for extending the cloth 24 a predetermined distance.

Figure 17:
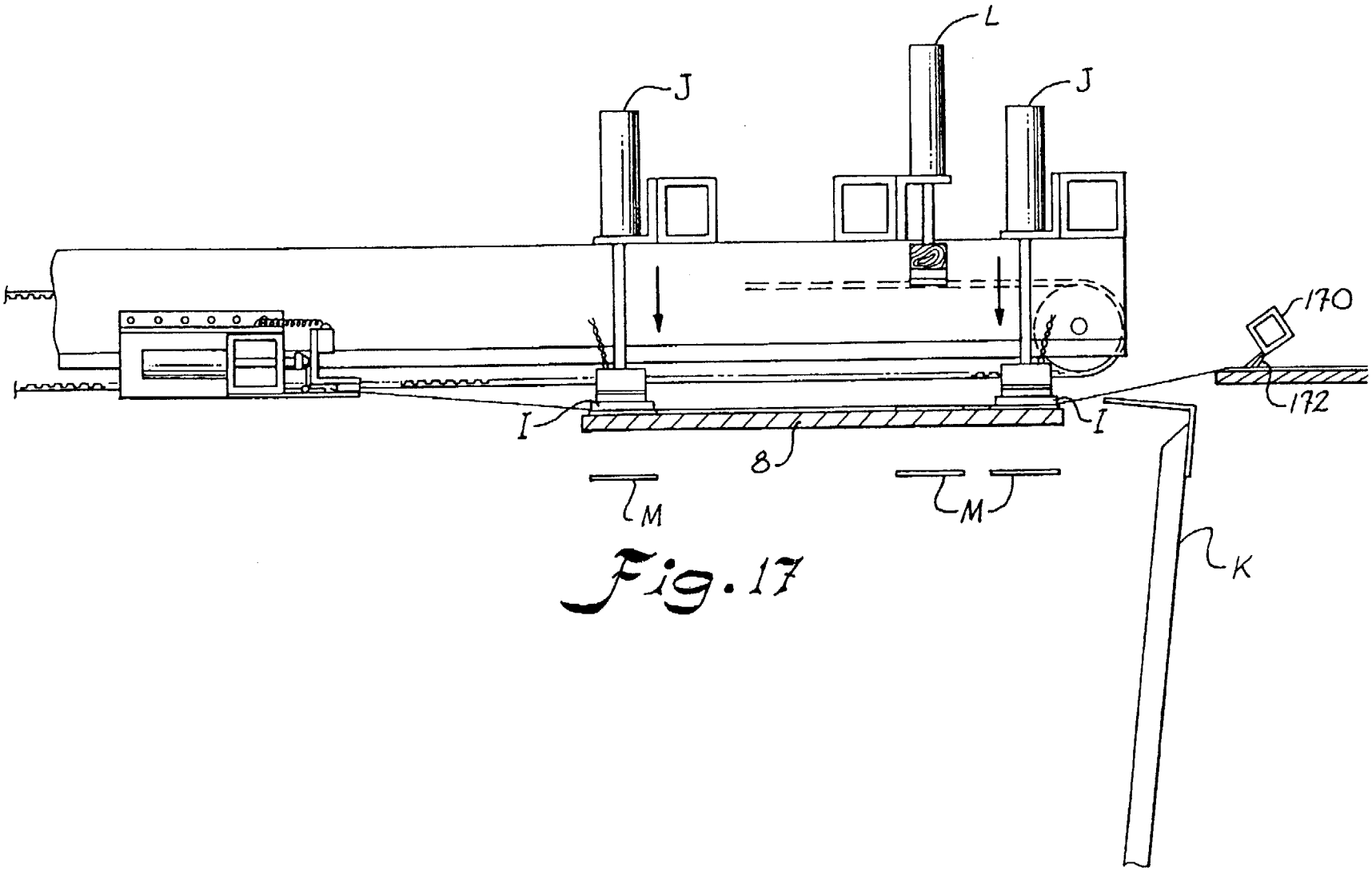
FIG. 17 is an end view of the cloth pulling mechanism and the folding table showing the dies being placed down on the cloth.
Figure 18:
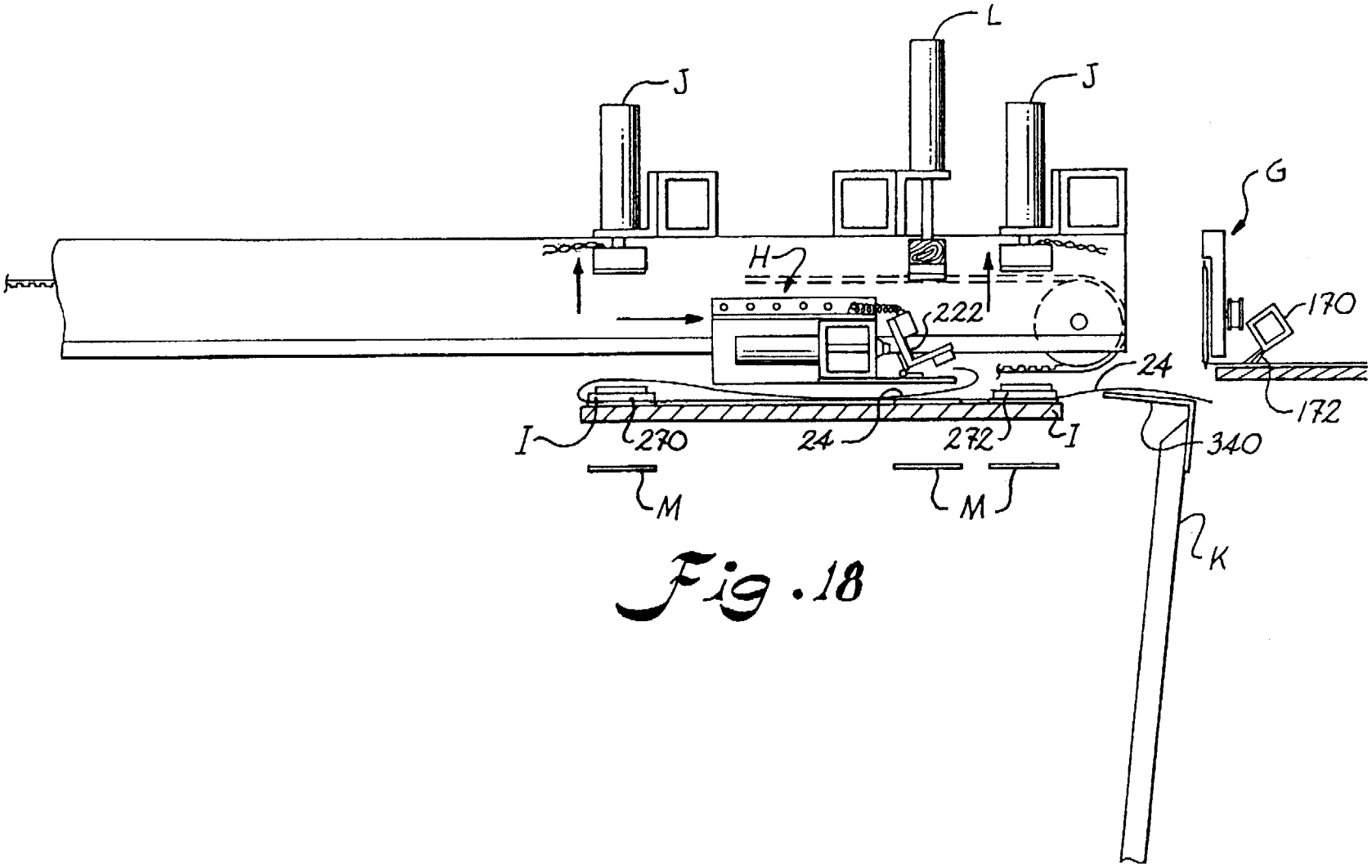
FIG. 18 is an end view illustrating the folding table and the first fold of the fabric forming a folded valance.

The next step in the sequence is activating the pneumatic cylinders forming part of die lifters J to lower the dies I down on top of the folding table 8 as shown in FIG. 17. At this point in time, the electromagnets carried on the end of the pistons associated with the lifting device are deenergized and leave the dies 270 and 272 on top of the extended cloth 24 such as shown in FIG. 22. The cloth puller and leading edge folder H is again moved back to the right as shown in FIG. 18, and while it is moving to the right, it has the leading edge of the cloth engagement between the gripping jaws. When it reaches the position such as shown in FIG. 18, the jaws of the gripping device 220 are open to release the cloth. As can be seen in FIG. 18, a single fold has been made in the cloth at this time.

Figure 19:
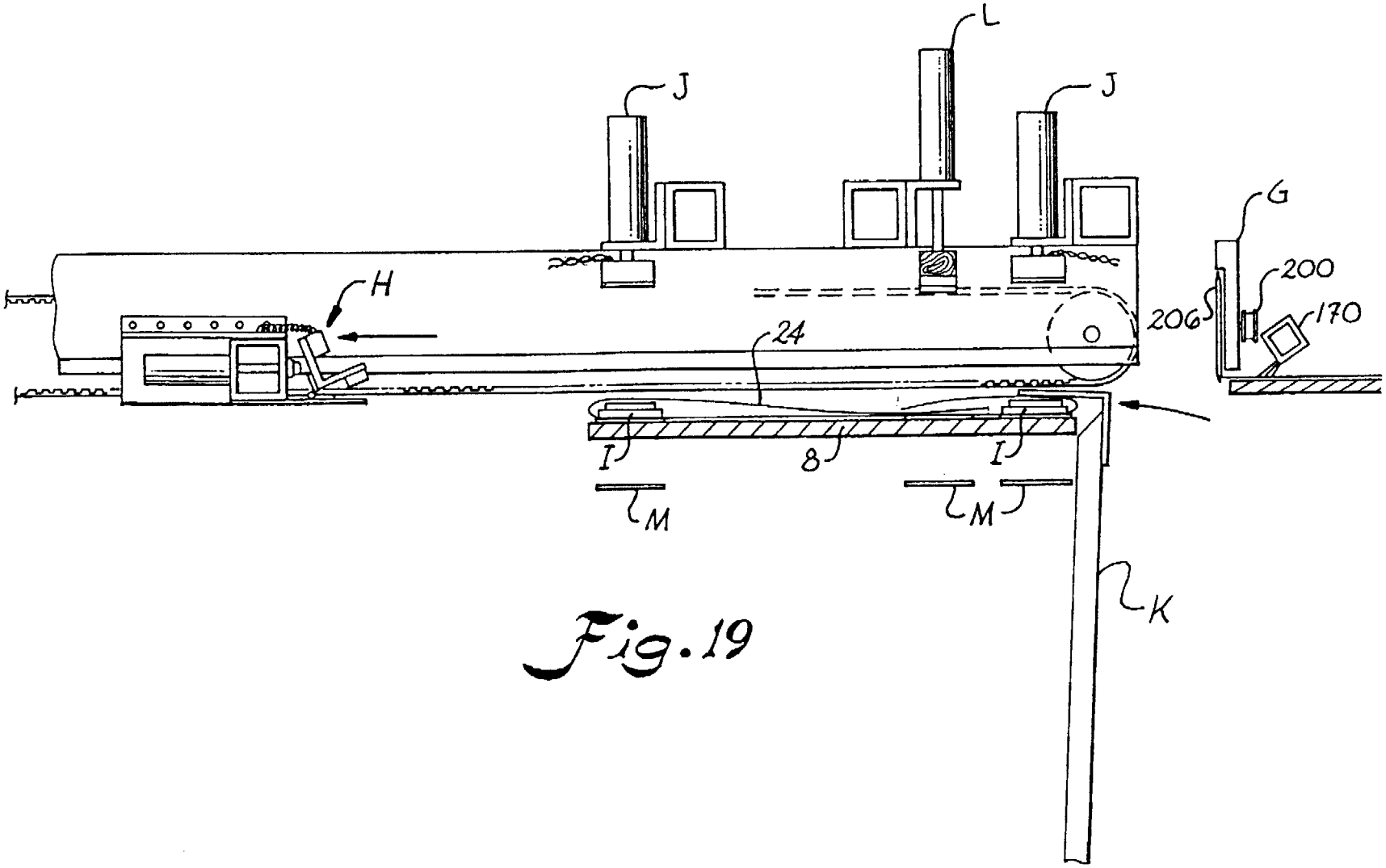
FIG. 19 is an end view illustrating a folding table illustrating the trailing edge of the fabric being folded into a valance.

A trailing end folder K has an L-shaped angled member 340 carried on the upper end thereof which in turn has the trailing end of the fabric 24 resting on top. By pivoting the trailing end folder in the forward direction, the angle member 340 pushes the trailing edge of the fabric over the die 272 to produce the folded pattern such as shown in FIG. 19. This folded pattern is now in position for being transported to a sewing station which will sew a hem in the edge of the upper fold and produce two elongated stitch lines along across the width of the entire valance to define a pocket and a socket in the valance.

Figure 20:
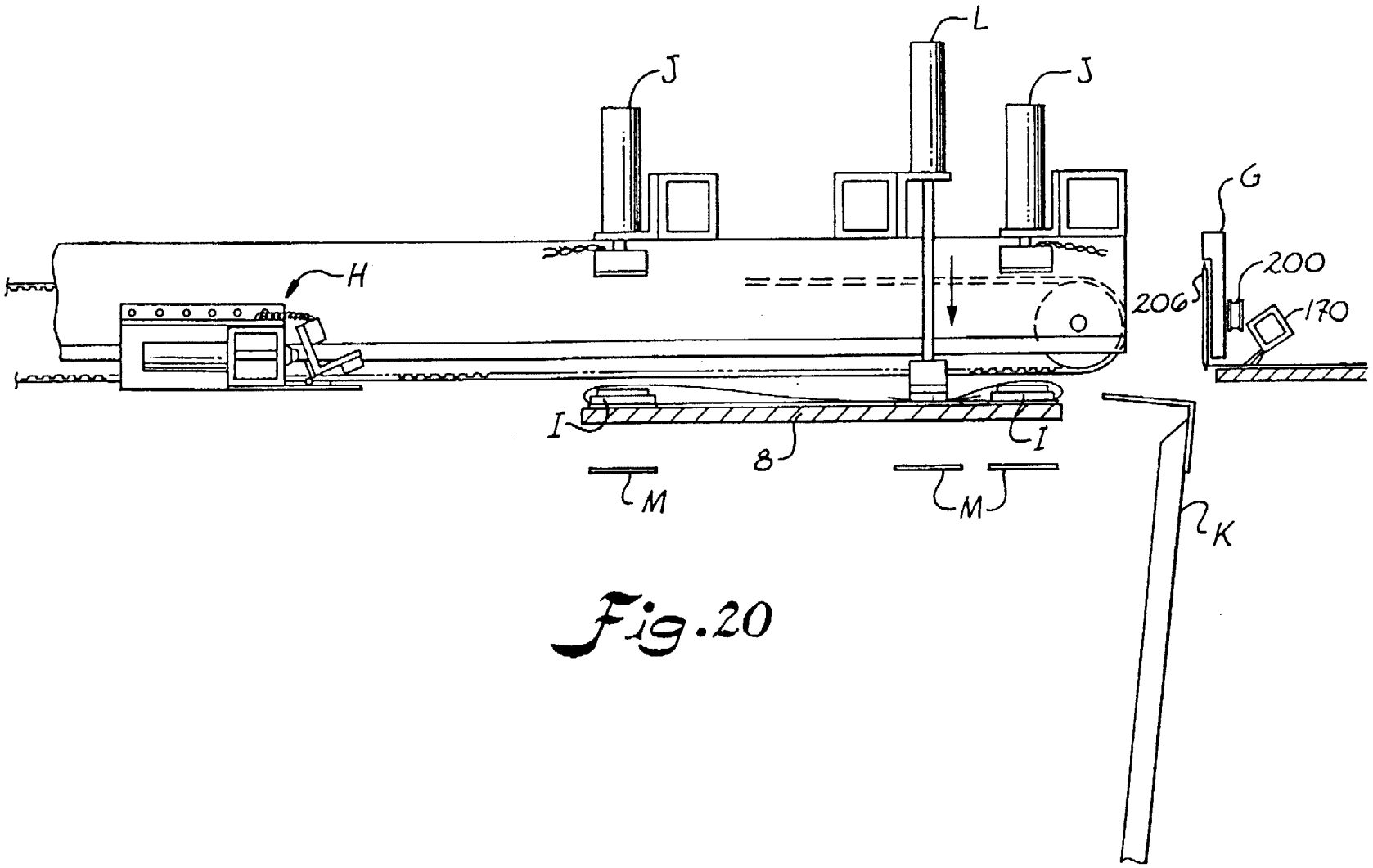
FIG. 20 illustrates an end view of the folding table showing the fabric in a folded condition immediately prior to being transported to a sewing mechanism.

The next step in the sequence is to lower the cloth hold down bar L onto the folded cloth pattern directly above the ends of the cloth as shown in FIG. 20. The cloth shifter M, which is in the form of three driven belts 350, 352, and 354, is used for shifting the folded pattern of cloth laterally from the folding table to an adjacent sewing station. The T-shaped attachments 282 carried on the end of the dies 270 and 272 prevent the dies from being moved laterally as the cloth is pulled by the moving belts 350, 352, and 354, off of the folding table into the next sewing station.

Figure 26:
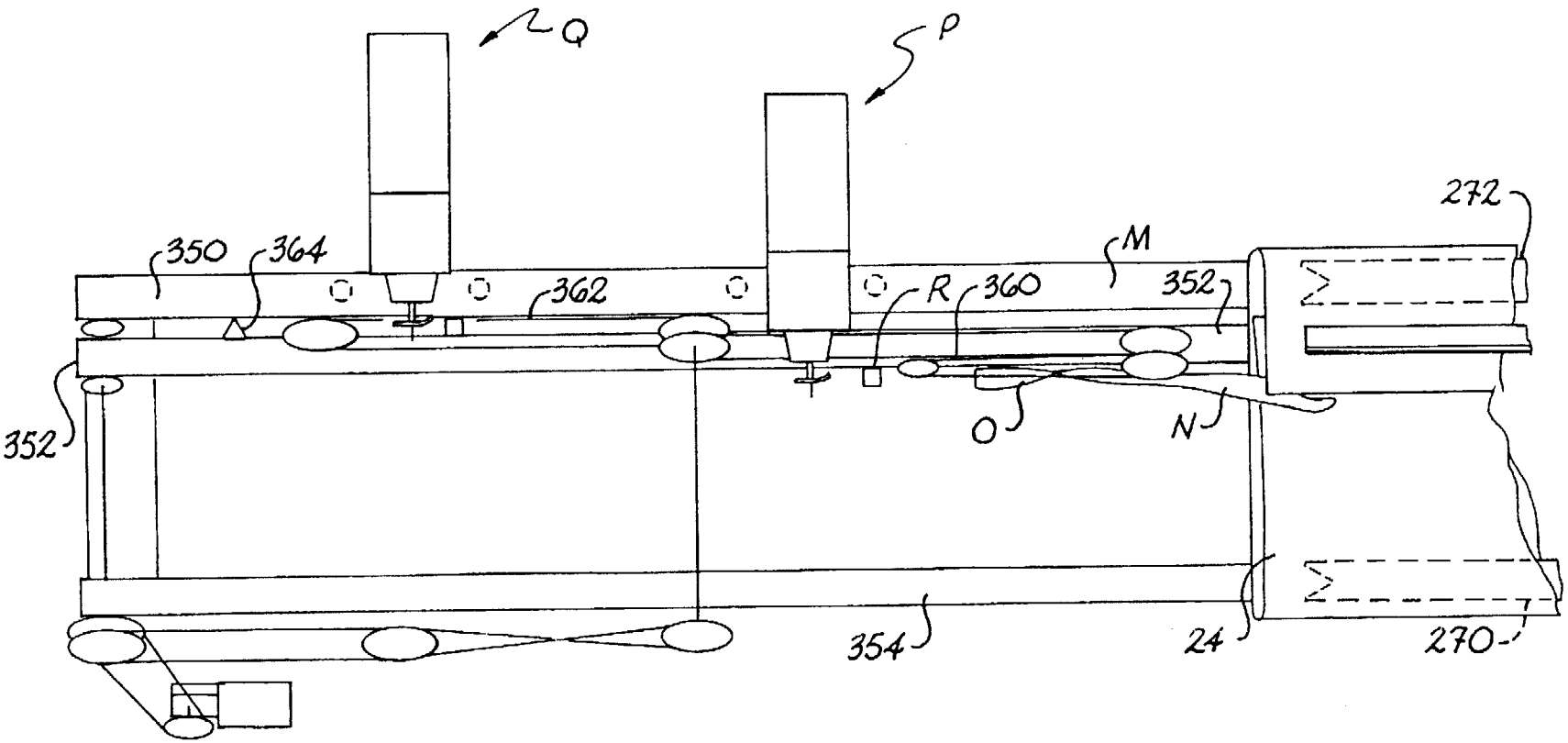
FIG. 26 is a plan view illustrating a final sewing station for sewing valances.

As can be seen in FIG. 26, the folded pattern of cloth 24 is carried on the movable belts 350, 352, and 354. The pattern 24 is held down flush against the belts 352 and 354 by spring loaded plates not shown. The upper edge of the cloth 24 engages a first driven belt 360. Prior to engaging the belt 360, the folded pattern 24 moves into engagement with an edge separating device N which includes a thin upwardly projecting finger that protrudes between the adjacent folds in the pattern of cloth 24 and feeds the edge of the upper fold into a conventional hem edge curler O which curls the edge under to form a hem.

The hem is then fed towards a first sewing machine P which has a single needle.

The purpose of the first sewing head P is to put a length of stitch across the entire folded pattern and to tack stitches adjacent to the leading edge of the valance and the trailing edge of the valance. A second sewing machine Q follows the first sewing machine, and its purpose is to place a stitch continuously across the entire valance. The second sewing head is offset from the first sewing head so that you have offset stitch lines to define a socket for receiving a curtain rod and a pocket for receiving filler material.

A controller is used for controlling the drive of the sewing machines P and Q as well as the drive for the moving belts 350, 352 and 354 and the upper belts 360 and 362.

A photocell R is carried by the first sewing machine P, and it generates a signal indicating that the leading edge of the folded pattern 24 has reached the sewing head. This causes a signal to be sent to the controller which slows down the conveying belts 350, 352 and 354 and the trailing sewing machine Q. The first sewing machine P continues to sew at its normal rate but since the movement of the fabric under the head has been slowed, more stitches per inch are placed in the leading edge of the folded fabric. This occurs for approximately one inch, depending on the preference of the customer.

The same tacking operation takes place at the trailing edge of the folded fabric. The controller can be set for activating the tacking operation according to the lengths of valances being produced.

After the two elongated stitches have been placed across the valances by the sewing heads P and Q, the thread extending between adjacent valances is cut by a thread cutter 364, and the valances are moved off the end of the sewing station onto a rotating folder which folds the valances into a rectangular package.

Proper spacing is maintained between the valances being transferred from the folding table 8 to the final sewing station by means of a photocell 370 that is positioned adjacent to the side of the folding table as shown in FIG. 25. This photocell senses the trailing and leading edges of the folded valances, and activates the controller which starts and stops the conveying and sequencing operation of the machine. Any suitable conventional controller can be used for synchronizing the various conveying and sewing operations taking place.

Figure 31:
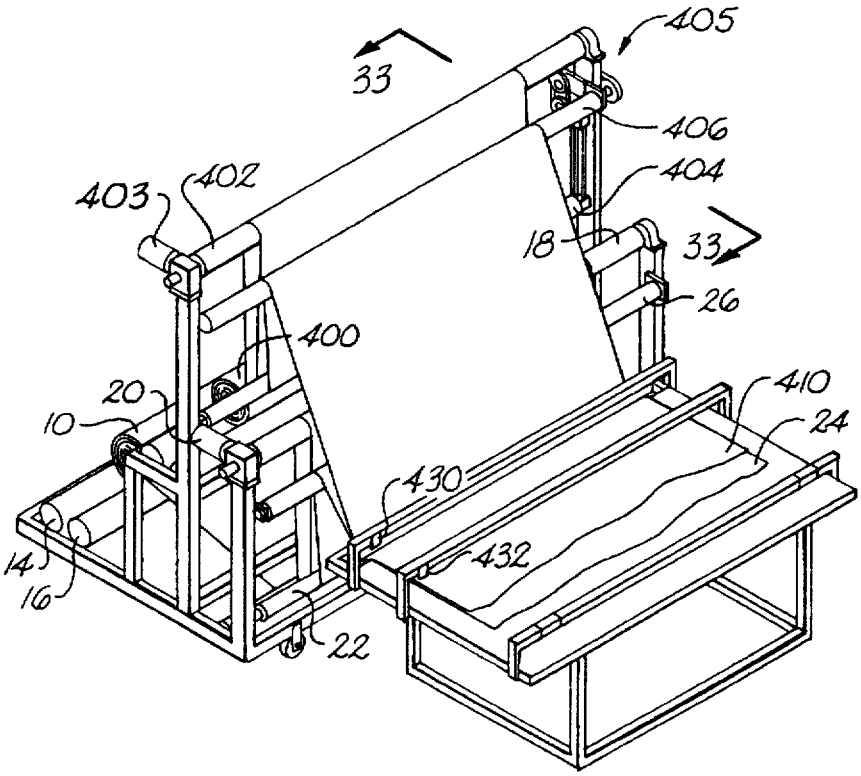
FIG. 31 is a perspective view of an apparatus for simultaneously feeding a face fabric and a liner into a fabric processing system.
Figure 32:
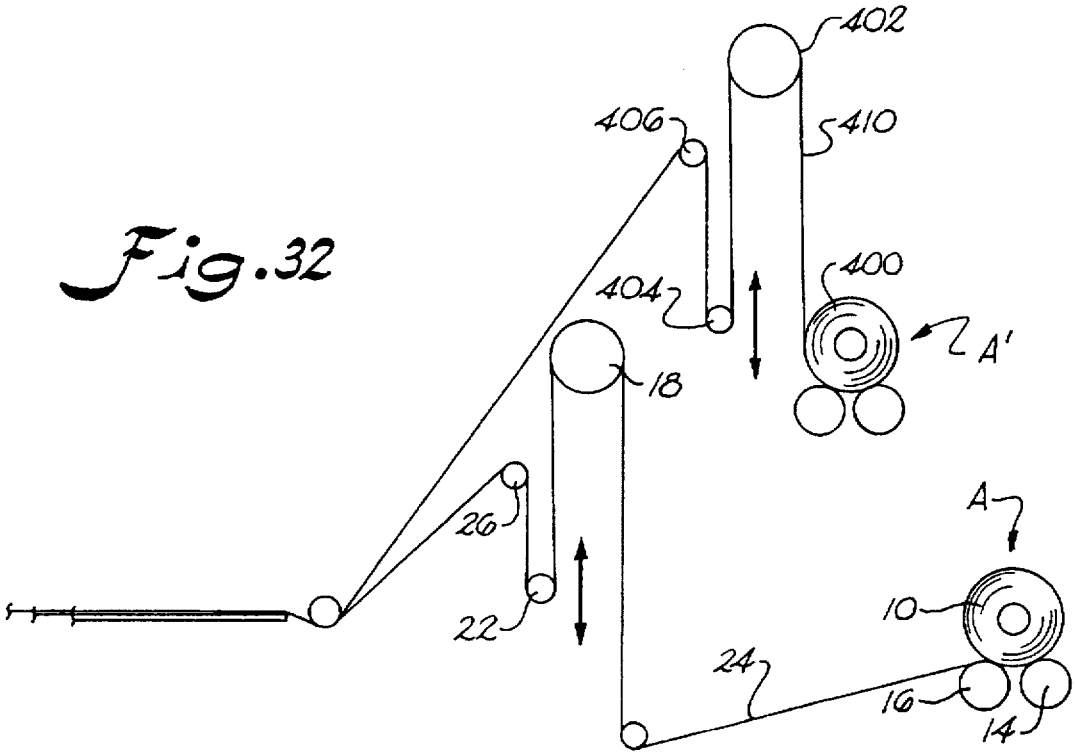
FIG. 32 is a side view of the apparatus illustrated in FIG. 31.

The apparatus of the present invention can also be adapted to feed two or more rolls of material simultaneously through the system as can be shown in FIGS. 25, 31, and 32. Many products including draperies, curtains, shower curtains, foam and fabric mattresses, and the like are made with multiple layers of material joined together. For instance, some draperies are made with a face fabric sewn to a liner. In the past, many problems have been encountered when attempting to feed two or more rolls of material simultaneously into a sewing operation. Usually, when attempting to feed two different fabrics together, each layer of fabric tends to develop a particular amount of stretch or inner tension. When the two fabrics are later cut and relaxed, one layer will tend to pull away or snap back from the other layer. Consequently, the two layers will fall out of alignment and fail to be evenly superimposed on one another.

Figure 29:
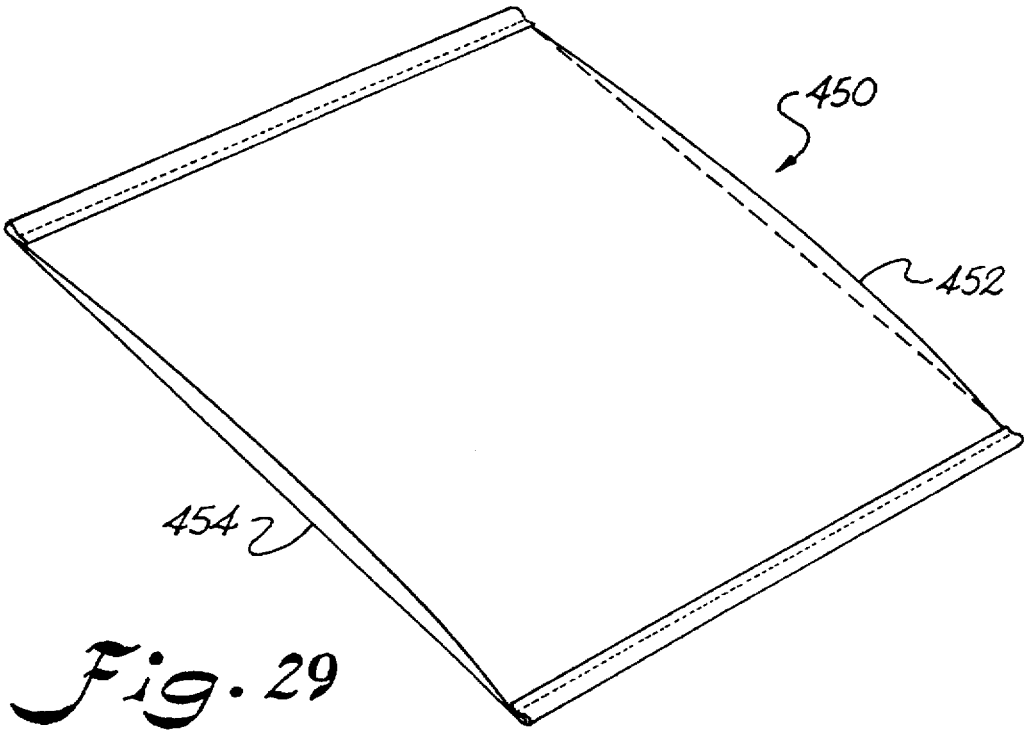
FIG. 29 is a perspective view of a prior art hemmed face fabric and liner.

Referring to FIG. 29, a hemmed product generally 450 is shown made according to prior art practices. Hemmed product 450 includes a liner fabric 452 that has been hemmed and sewn to a face fabric 454. Liner fabrics are typically made from a much lighter material than face fabrics. As such, when attempting to feed a face fabric with a liner fabric from respective rolls of material into a sewing operation, the lighter liner fabric tends to become more stretched than the face fabric. As shown in FIG. 29, when the two fabrics are later cut, the edge of liner 452 snaps back away from the edge of face fabric 454.

When this occurs, the two layers of fabric fall out of alignment with respect to each other. An additional cutting operation or other procedure must be performed in order to realign the edges of the fabrics. There will always be, however, a differential amount of stretch present within each fabric which cannot be removed after the two layers are sewn together. This differential amount of stretch may cause the resulting product not to function properly for its intended purpose.

Figure 30:
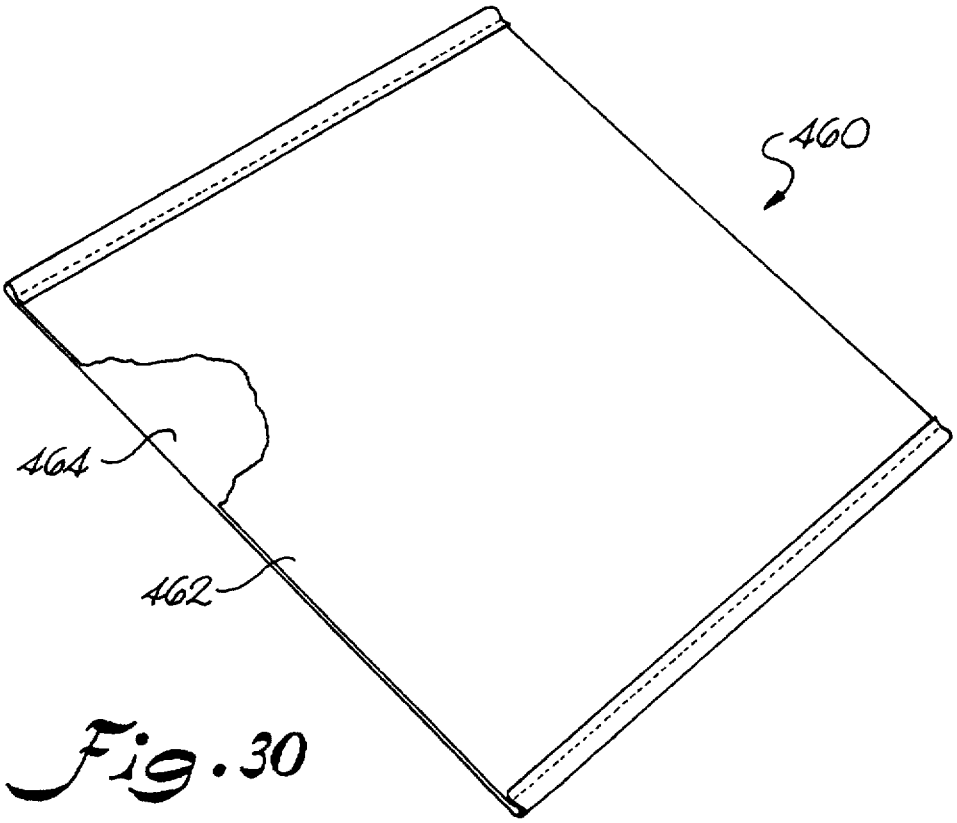
FIG. 30 is a perspective view with parts broken away for the purpose of clarity illustrating a hemmed face fabric and liner.

Referring to FIG. 30, a hemmed product generally 460 made according to the present invention is illustrated. Hemmed product 460 includes a liner fabric 462 that has been sewn and hemmed to a face fabric 464. By using the apparatus and method of the present invention, as will be described in more detail, a face fabric and a liner can be automatically fed into a sewing and cutting operation while maintaining the edges of the two fabrics in alignment and without creating a stretch differential in the resulting product.

The method and apparatus of feeding two rolls of material simultaneously will now be described with particular reference to FIGS. 25, 31, 32, and 33. As shown in FIGS. 25, 31, and 32, a second roll of fabric 400 such as a liner is carried on a second let off A'. The let off A' includes a power driven roll 402 which has a friction covering thereon. Similar to as described above, power driven roll 402 is driven by an electric motor 403. Motor 403 is a variable speed driven motor. The speed of the motor can be placed under the control of a tension supplying means such as a dancer roll 404 which can apply a predetermined amount of tension or weight to the fabric. The dancer roll 404 is permitted to move up and down responsive to variations in tension in the cloth extending therearound as the cloth is pulled into various sewing and cutting processes. As the dancer roll 404 moves up and down, the voltage applied to the motor drive board is varied for varying the let off speed of the cloth.

Similar to roll let-off A, variable speed motor 403, in combination with dancer roll 404, acts as a tension control unit for feeding fabric to the system at a constant tension. Of course, other forms of tension control units can be used in the apparatus of the present invention as would be apparent to one skilled in the art. For instance, a tension control apparatus is disclosed in U.S. Pat. No. 3,525,367 to Sprague which is incorporated herein by reference.

In order to ensure that fabrics 24 and 410 are each fed to the system at a constant tension as described above, in one embodiment dancer rolls 22 and 404, as shown in FIGS. 25, 31, and 32, can have a predetermined weight. For instance, dancer roll 22 can weigh 10 pounds which is then supported by cloth 24. Further, in order to make the weight of the dancer rolls adjustable, a tool balance can be placed in operative association with the rolls. Specifically, the tool balance can be suspended above and connected to the dancer rolls. The balance can then be adjusted to absorb a particular amount of the weight of the roller. Less weight is then supported by the fabric.

According to the present invention, unlike roll let off A, roll let off A' further includes a second power driven roll 406. Roll 406 is in operative engagement with a torque supplying device generally 405 as shown in FIG. 31. Torque supplying device 405 preferably applies a predetermined amount of torque to roll 406 but does not affect the rotational speed of the roll. Power driven roll 406 in combination with torque supplying device 405 is added to let off A' in order to adjustably place the liner under a different tension in comparison to the face fabric for feeding the two fabrics simultaneously and in alignment.

For instance, in one embodiment, dancer roll 22 can be set at a particular weight for feeding cloth 24 at a predetermined and constant tension. Dancer roll 404 is then also set at a heavier weight. However, by including torque supplying device 405 in operative association with roll 406, the weight supported by the liner 410 from dancer roll 404 can be varied. This adjustment can be made in response to the tension being exerted on the cloth by the sewing heads and cloth advancers E in comparison to the amount of tension being exerted on cloth 24. Once a proper adjustment in the tension of liner 410 is made, the liner 410 and cloth 24 should feed simultaneously and uniformly.

In this arrangement, power roller 406 always applies a continuous torque to liner 410 for placing in equilibrium the rate at which the liner and the cloth are fed to the sewing heads. The level lining apparatus as described herein feeds both the liner and the cloth at a constant tension. However, a different amount of tension is placed on the liner in comparison to the cloth. Different amounts of tension are applied in order to compensate for differences in the makeup of the fabrics (such as weight, denier, texture, etc.) and for the different effects that the sewing and cutting apparatus have on the fabrics.

Figure 33:
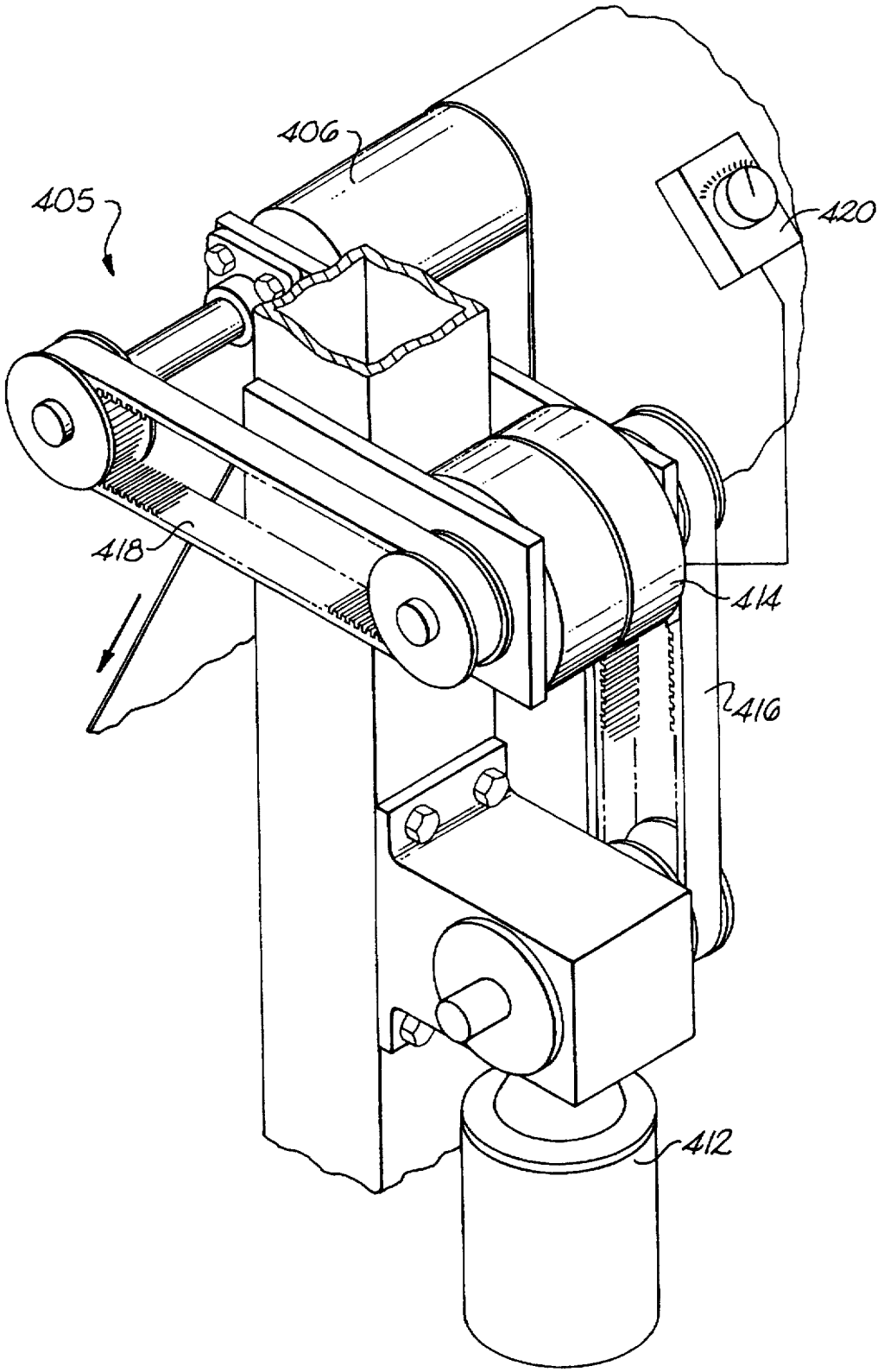
FIG. 33 is an enlarged perspective view illustrating a torque supplying device that is used in conjunction with a roll let-off.

One type of torque supplying device 405 that can be used in the present invention is illustrated in FIG. 33. Torque supplying device 405 includes an electric motor 412 in operative association with a hysteresis clutch 414. A belt 416 interconnects motor 412 with hysteresis clutch 414, while a similar belt 418 interconnects clutch 414 with roller 406.

In this arrangement, motor 412 via hysteresis clutch 414 applies a predetermined amount of torque to roller 406. Hysteresis clutch 414 further includes a control device 420 for increasing or decreasing the amount of torque applied to the roller.

Of course, the motor and clutch arrangement illustrated in FIG. 33 is merely one embodiment of a torque supplying device. Any device can be used in the present invention that is capable of applying a continuous amount of torque to a roller without affecting the let-off speed of the fabric. For instance, a torque motor can also be used in the present invention.

A detailed explanation of the operation of the level lining apparatus of the present invention will now be discussed with reference to a particular example. The following example is offered to illustrate the invention and is not intended to limit the invention to any particular form or embodiment.

A level lining apparatus similar to the embodiment illustrated in FIGS. 25, 31, and 32, was used to form a hemmed product comprising a liner sewn to a face fabric. The liner fabric used was much lighter than the face fabric.

A roll of the face fabric was placed on roll let-off A and threaded around the guide rolls. Dancer roll 22 was set at 5 pounds, and the fabric was fed through the system at a constant tension.

A roll of the liner fabric was placed on roll let-off A'. Dancer roll 404 for the liner fabric was set at 10 pounds. In this example, a hysteresis clutch and motor arrangement were used to provide a torque to roll 406. Specifically, the hysteresis clutch was capable of providing a predetermined amount of torque that corresponded to removing from 0 to 10 pounds of tension from the liner caused by the weight of the dancer roll 404. In other words, by adjusting the control device on the hysteresis clutch, the resulting amount of torque that was applied to roll 406 compensated for the weight of dancer roll 404, having the effect of being able to incrementally decrease the apparent weight of dancer roll 404 anywhere from 10 down to 0 pounds.

For instance, as described above, the face fabric was set at 5 pounds. Using torque supplying device 405 in combination with a 10 pound dancer roll, the weight applied to the liner fabric was capable of being varied anywhere from 0 to 10 pounds. The hysteresis clutch was then adjusted so that a resulting tension was placed on the liner fabric that allowed the liner fabric and the face fabric to feed simultaneously and uniformly into the system.

In summary, the method of the present invention for feeding at least two rolls of material simultaneously includes the steps of first setting the face fabric at a constant tension. Next, the liner fabric is set at a constant tension. A torque supplying device is provided for adjusting the tension placed on the liner fabric. In particular, using the torque supplying device, the tension on the liner fabric is set at a point where the liner and face fabric are fed together into the system without creating any differential stretch between the two layers.

Referring to FIG. 31, the level lining apparatus illustrated therein further includes a pair of photoelectric sensors 430 and 432. Sensors 430 and 432 are for sensing the edges of cloths 24 and 410 respectively. The sensors can be used to ensure that the two fabrics remain in vertical alignment as they are processed.

In one embodiment, photosensors 430 and 432 can send a signal to a controller which in turn controls shifting devices that are capable of horizontally shifting (i.e., moving to the left or right) the rolls of materials that are supported on the let-offs. For instance, the roll shifting devices can include hydraulic cylinders or linear actuators that are arranged in order to shift the horizontal positions of the rolls of material. As shown in FIG. 1, the shifting device can be used to shift idle rollers 14 and 16, the roll of material itself 10, or even the support frame upon which the idle rollers are supported.

During operation, if photoelectric sensors 430 or 432 detect that the edge of the face fabric or the liner are not at a predetermined position, the shifting device can be actuated for realigning the fabric. Preferably, the shifting device will shift the fabric to the left or right in small increments, such as at 1/16 of an inch at a time.

By using the level lining apparatus in combination with a vertical edge guidance system, various improved sewn products can be produced. For instance, one major and unexpected advantage to using the apparatus of the present invention is the capability of automatically making sewn products containing a face fabric and a liner, wherein the liner is narrower than the face fabric. Specifically, referring to FIG. 34 a face fabric 500 and a liner 502 having a narrower width than the face fabric are illustrated prior to being hemmed or sewn together. When constructing sewn products that include a face fabric in combination with a liner, the vertical edges of the fabrics are typically hemmed together in a double hem arrangement. Score lines 504 and 508 and score lines 506 and 510 represent the fold lines for forming the vertical hems.

Figure 35:
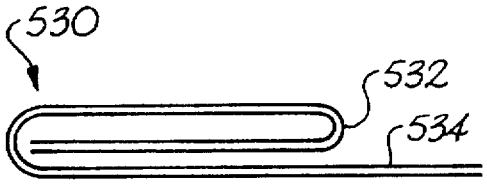
FIG. 35 is a side view of a prior art double folded hem including a face fabric and a liner.

Referring the FIG. 35, a double folded hem generally 530 is shown including a face fabric 532 and a liner fabric 534. Specifically, this embodiment represents past practices in which the liner fabric and the face fabric were of the same width. As shown, when creating a double folded hem 530 in this embodiment, the resulting hem is six layers of fabric thick.

Figure 34:
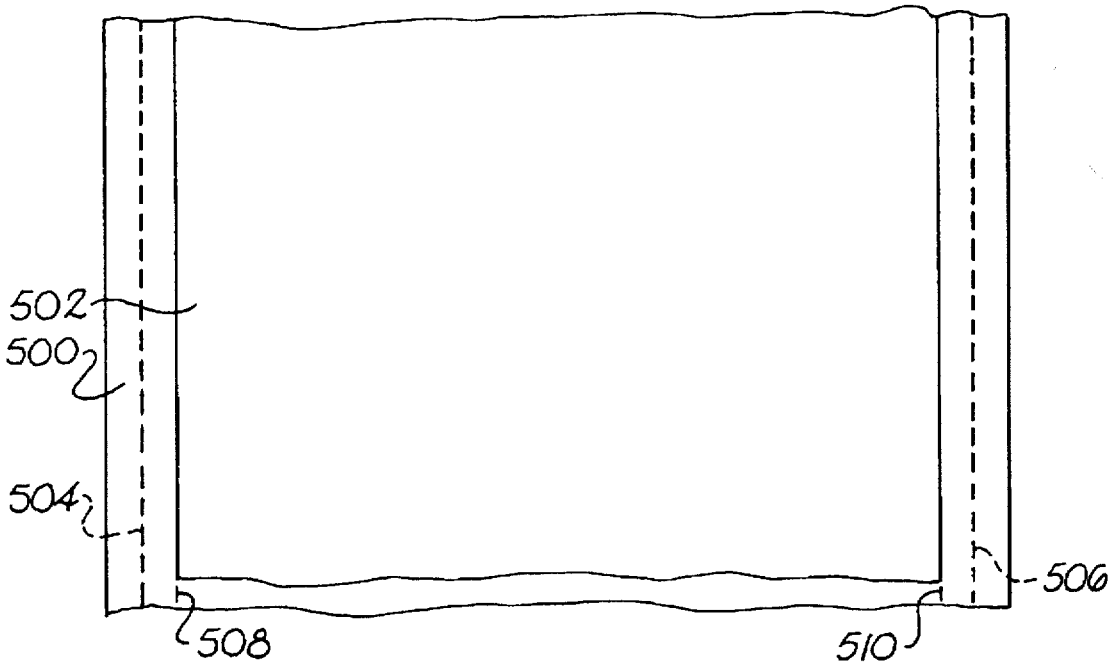
FIG. 34 is a plan view of a face fabric and a liner wherein the liner is narrower than the face fabric.
Figure 36:
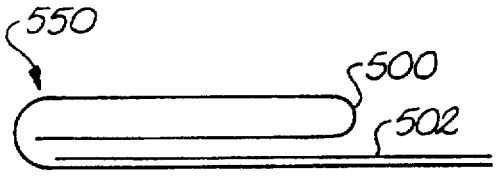
FIG. 36 is a side view of a double folded hem including a liner that is narrower than the face fabric.

FIG. 36, on the other hand, represents a double folded hem generally 550 that would be made from the liner and face fabric arrangement illustrated in FIG. 34. As shown, by using a liner fabric narrower than the face fabric, the resulting hem is only four layers of fabric thick, thereby eliminating two layers of fabric from the hem. This result is particularly significant when the bottom or top of the sewn product is also hemmed. For example, if the bottom of the product were similarly hemmed with a double fold, the vertical hem would be folded upon itself twice at each of the bottom corners. If this were to occur, hem 530 shown in FIG. 35 would produce a bottom corner that was 18 layers of fabric thick while the embodiment illustrated in FIG. 36 would only be 12 layers thick.

There are many advantages to reducing the number of layers that are found in any particular hem. For instance, each layer added to a hem makes it more difficult to sew the hem. Increasing the number of layers that are present makes it harder to force a needle into the fabric, generates more heat between the fabric and the needle, and increases the likelihood of needle breakage. Another advantage to using a liner fabric that is narrower than the face fabric is that less liner fabric is needed to make the finished product. Further, thicker hems can adversely interfere with the appearance of the product. For instance, when included in a curtain or drapery, a thicker hem may not hang correctly. As such, the present invention is further directed to an improved hemmed product and a method of making same.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to be limitative of the invention so further described in such appended claims.

What is claimed is:

1. An apparatus for automatically and simultaneously feeding a base fabric and a liner fabric into a fabric processing system, wherein the base fabric and liner fabric are fed to the system at different tensions for maintaining the fabrics in alignment, said apparatus comprising:

a base fabric supply;

a first power driven roll for receiving base fabric from said base fabric supply, said roll being driven by a motor;

a first dancer roll in operative association with said first power driven roll, said dancer roll receiving said base fabric therearound, wherein said dancer roll varies the speed of said first power driven roll in response to variations in fabric tension occurring downstream for feeding said base fabric to said fabric processing system at a constant tension;

a liner fabric supply;

a second power driven roll for receiving liner fabric from said liner fabric supply, said second power driven roll being driven by a second motor;

a second dancer roll for receiving said liner fabric therearound, said second dancer roll varying the speed of said second power driven roll based on variations in the liner fabric tension, said second dancer roll applying a preselected amount of tension to said liner fabric; and a drive roll adapted to receive said liner fabric, said drive roll being in operative association with a torque supplying device, said device applying a constant torque to said drive roll for increasing or decreasing the amount of tension being applied to said liner fabric, wherein the tension being applied to said liner fabric can be adjusted by adjusting the amount of torque being delivered to said drive roll for setting said tension at a point where said liner fabric and said base fabric will feed into said system simultaneously.

2. An apparatus as defined in claim 1, wherein said second dancer roll has a preselected weight for applying said preselected amount of tension to said liner fabric.

3. An apparatus as defined in claim 1, wherein said torque supplying device comprises a motor in operative association with a hysteresis clutch for adjustably applying a constant and continuous torque to said drive roll.

4. An apparatus as defined in claim 1, wherein said torque applied to said drive roll by said torque supplying device counteracts the tension applied to said liner fabric by said second dancer roll for decreasing the total amount of tension placed on said fabric by said apparatus.

5. An apparatus as defined in claim 1, wherein said base fabric supply and said liner fabric supply comprise roll let-offs adapted to rotatably support respective rolls of material.

6. An apparatus as defined in claim 1, further comprising a first sensing device and a second sensing device, said first sensing device for monitoring the position of a vertical edge of said base fabric, said second sensing device for monitoring the position of a vertical edge of said liner fabric.

7. An apparatus as defined in claim 6, further comprising a first fabric shifting device in operative association with said first sensing device and a second fabric shifting device in operative association with said second sensing device, said sensing devices causing said respective shifting devices to incrementally shift the positions of said respective base fabric and said liner fabric based on variations in the position of said vertical edges for maintaining said edges in a preset range.

8. An apparatus as defined in claim 7, wherein said fabric shifting devices comprise hydraulic cylinders.

9. An apparatus as defined in claim 1, wherein said first dancer roll applies a first amount of weight to said base fabric and said second dancer roll applies a second amount of weight to said liner fabric, said second amount of weight being greater than said first amount of weight, and wherein said torque supplying device delivers a torque to said drive roll that in turn counteracts said second amount of weight being applied to said liner fabric for decreasing the total amount of tension being applied to said liner fabric, said torque supplying device being adjustable for setting the torque being delivered to said drive roll at a level that allows both fabrics to feed uniformly.

10. A method for simultaneously feeding a first material and a second material to a fabric processing system, said materials being fed to said system as adjacent layers, wherein said method maintains said layers in alignment, said method comprising the steps of:

feeding a first material to said fabric processing system at a constant tension;

feeding a second material to said fabric processing system simultaneously with said first material, said second material being superimposed with said first material;

applying a predetermined amount of tension to said second material; and applying an adjustable force to said second material, said force counteracting said predetermined amount of tension for lessening the total amount of tension applied to said second material, wherein said force is adjusted in response to said constant tension being applied to said first material in order to feed said second material simultaneously with said first material into said fabric processing system.

11. A method as defined in claim 10, wherein said force is applied to said second material by applying a constant torque to a guide roll upon which said second material is conveyed.

12. A method as defined in claim 10, wherein said predetermined amount of tension applied to said second material is greater than said constant tension being applied to said first material.

13. A method as defined in claim 10, wherein said force is applied to said second material for increasing the total amount of tension being applied to said second material.

14. A method as defined in claim 10, further comprising the step of maintaining a vertical edge of said first material in relative alignment with a vertical edge of said second material by incrementally shifting the horizontal positions of said materials.

15. An apparatus for simultaneously feeding at least two rolls of material into a fabric processing system, said apparatus comprising:

a first roll let-off for supporting a roll of a first material;

a first tension control unit for receiving said first material from said first roll let-off and for feeding said first material to said system at a constant tension, said tension control unit including a power driven roll in operative association with a tension supplying means, wherein said tension supplying means delivers a constant and predetermined amount of tension to said first material, said tension supplying means varying the speed of said power driven roll in response to changes in fabric tension occurring downstream such that the speed of said power driven roll is increased when tension in the fabric downstream increases and such that the speed of said power driven roll is decreased when tension in the fabric downstream decreases;

a second roll let-off for supporting a roll of a second material that is to be fed to said system simultaneously with said first material;

a second tension control unit for receiving said second material from said second roll let-off, said second tension control unit including a power driven roll in operative association with a tension supplying means, wherein said tension supplying means delivers a constant and predetermined amount of tension to said second material;

a drive roll for receiving said second material from said second tension control unit; and a torque supplying device in operative association with said drive roll for supplying a constant torque thereto, wherein said torque supplying device in combination with said second tension control unit applies a resulting tension to said second material, said torque supplying device being adjustable for adjusting the tension placed on said second material for maintaining said second material in alignment with said first material as said materials are fed through said fabric processing system.

16. An apparatus as defined in claim 15, wherein each of said tension supplying means comprises a dancer roll for receiving said materials from said power driven rolls, said dancer rolls having a preselected weight that is applied to and supported by said respective materials.

17. An apparatus as defined in claim 15, wherein said torque supplying device comprises a motor in operative association with a hysteresis clutch for adjustably applying a constant and continuous torque to said drive roll.

18. An apparatus as defined in claim 15, wherein said torque applied to said drive roll by said torque supplying device counteracts the tension applied to said second material by said second tension control unit for decreasing the total amount of tension placed on said second material.

19. An apparatus as defined in claim 15, further comprising a first sensing device and a second sensing device, said first sensing device monitoring the position of a vertical edge of said first material, said second sensing device for monitoring the position of a vertical edge of said second material, wherein said sensing devices are in operative association with a first fabric shifting device and a second fabric shifting device respectively, wherein said sensing devices control said respective shifting devices to incrementally shift the horizontal positions of said respective materials for maintaining said edges of said materials in relative alignment.

20. An apparatus for simultaneously feeding a first material and a second material into a fabric processing system comprising:

a first tension control unit for applying a constant and predetermined amount of tension to said first material, said first tension control unit comprising a weighted dancer roll;

a second tension control unit for applying a constant and predetermined amount of tension to said second material; and a torque supplying device in operative association with a drive roll upon which said second material is supported, said torque supplying device adjustably supplying a constant torque to said drive roll for counteracting said predetermined amount of tension being exerted on said second material by said second tension control unit, wherein said torque applied to said drive roll by said torque supplying device is adjusted to feed said second material simultaneously with said first material into said fabric processing system.

21. An apparatus for simultaneously feeding a first material and a second material into a fabric processing system comprising:

a first tension control unit for applying a constant and predetermined amount of tension to said first material;

a second tension control unit for applying a constant and predetermined amount of tension to said second material; and a torque supplying device in operative association with a drive roll upon which said second material is supported, said torque supplying device adjustably supplying a constant torque to said drive roll for counteracting said predetermined amount of tension being exerted on said second material by said second tension control unit, wherein said torque applied to said drive roll by said torque supplying device is adjusted to feed said second material simultaneously with said first material into said fabric processing system, wherein said torque supplying device comprises a motor in operative association with a hysteresis clutch.

22. An apparatus as defined in claim 20, wherein said first tension control unit further comprises a power driven roll in operative association with said dancer roll, said dancer roll receiving said first material therearound, wherein said dancer roll varies the speed of said first power driven roll in response to variations in fabric tension occurring downstream for feeding said first material to said fabric processing system at a constant tension.

23. An apparatus as defined in claim 21, wherein said first tension control unit comprises a power driven roll in operative association with a dancer roll, said dancer roll receiving said first material therearound, said dancer roll varying the speed of said first power driven roll in response to variations in fabric tension occurring downstream for feeding said first material to said fabric processing system at a constant tension.

* * * * *